US007766631B2

(12) United States Patent
Kitahara et al.

(10) Patent No.: US 7,766,631 B2
(45) Date of Patent: Aug. 3, 2010

(54) PISTON PUMP

(75) Inventors: Michio Kitahara, Saitama (JP); Paul Patterson, Saitama (JP)

(73) Assignee: KMC Litd., Saitama (JP)

( * ) Notice: Subject to any disclaimer, the term of this patent is extended or adjusted under 35 U.S.C. 154(b) by 810 days.

(21) Appl. No.: 10/510,417

(22) PCT Filed: Apr. 8, 2003

(86) PCT No.: PCT/JP03/04456

§ 371 (c)(1),
(2), (4) Date: Apr. 21, 2005

(87) PCT Pub. No.: WO03/085263

PCT Pub. Date: Oct. 16, 2003

(65) Prior Publication Data

US 2005/0175489 A1 Aug. 11, 2005

(30) Foreign Application Priority Data

Apr. 8, 2002 (JP) ..... 2002-105675

(51) Int. Cl.
*F04B 39/10* (2006.01)
*F04B 53/12* (2006.01)

(52) U.S. Cl. ..... 417/552; 417/545; 417/547; 29/888.02

(58) Field of Classification Search ..... 417/435, 417/460, 466, 495, 502, 511, 513, 510, 520, 417/415; 128/680, 681, 682; 92/155, 168; 29/888.02

See application file for complete search history.

(56) References Cited

U.S. PATENT DOCUMENTS 3,931,755 A * 1/1976 Hatridge ..... 92/155
4,343,314 A * 8/1982 Sramek ..... 600/493
4,770,058 A 9/1988 Lilie et al.
5,110,271 A * 5/1992 Hofmann ..... 417/555.1
5,188,519 A * 2/1993 Spulgis ..... 417/511

(Continued)

FOREIGN PATENT DOCUMENTS

CN 86 1 01340 A 11/1986

(Continued)

OTHER PUBLICATIONS

Office Action from corresponding Japanese Patent Application No. 2003-582418, dated Nov. 6, 2009, 3 pages.

*Primary Examiner*—Charles G Freay
*Assistant Examiner*—Patrick Hamo
(74) *Attorney, Agent, or Firm*—Brinks Hofer Gilson & Lione

(57) ABSTRACT

To provide an efficient piston pump having a small number of parts and simple assembly steps, and consuming less current in achieving a relatively low ultimate pressure. The piston pump comprises: a suction port (28) through which gas sucked by varying the volume of a pump chamber (22) defined by a cylinder (12) and a piston (14) fitted in the cylinder (12) passes as the piston (14) is reciprocated, an exhaust port (20) through which the gas discharged by varying the volume of the pump chamber (22) passes, a suction valve (26) installed in the suction port (28) disposed on a piston top, and an exhaust valve (18) installed in the exhaust port (20) disposed on a top of the cylinder (12).

3 Claims, 19 Drawing Sheets

U.S. PATENT DOCUMENTS

| | | | | | |
|---|---|---|---|---|---|
| 5,593,288 | A | * | 1/1997 | Kikutani | 417/435 |
| 5,847,264 | A | * | 12/1998 | Martin et al. | 73/40 |
| 5,848,879 | A | * | 12/1998 | Hansson | 417/521 |
| 6,024,366 | A | * | 2/2000 | Masamura | 280/124.162 |
| 6,082,244 | A | * | 7/2000 | Siegel et al. | 92/78 |
| 6,095,758 | A | | 8/2000 | Chou | |
| 6,168,393 | B1 | * | 1/2001 | Huber et al. | 417/360 |
| 6,193,109 | B1 | * | 2/2001 | Credle et al. | 222/129.4 |
| 6,361,290 | B1 | | 3/2002 | Ide | |
| 2003/0206817 | A1 | * | 11/2003 | Oh et al. | 417/417 |

FOREIGN PATENT DOCUMENTS

| | | | | | |
|---|---|---|---|---|---|
| CN | 2208108 | Y | | 9/1995 | |
| CN | 2319605 | Y | | 5/1999 | |
| CN | 1077954 | C | | 1/2002 | |
| JP | 48-37289 | | | 11/1973 | |
| JP | 49-21914 | | | 6/1974 | |
| JP | 58-111466 | | | 7/1983 | |
| JP | 62-248878 | | | 10/1987 | |
| JP | 63-001856 | | | 1/1988 | |
| JP | 63-289276 | | | 11/1988 | |
| JP | 02-42253 | | | 11/1990 | |
| JP | 04-214970 | | | 8/1992 | |
| JP | 04-214970 | A | | 8/1992 | |
| JP | 04-224289 | | | 8/1992 | |
| JP | 05-157049 | | | 6/1993 | |
| JP | 6-37580 | | | 5/1994 | |
| JP | 7-7921 | | | 3/1995 | |
| JP | 08-189468 | | * | 7/1996 | |
| JP | 08-338369 | | | 12/1996 | |
| JP | 09-209921 | | | 8/1997 | |
| JP | 2000-120550 | | | 4/2000 | |
| JP | 2000287843 | | * | 10/2000 | |
| JP | 2001012354 | A | * | 1/2001 | 417/511 |
| WO | WO 00/63558 | | | 10/2000 | |

* cited by examiner

PISTON PUMP

FIELD OF THE INVENTION

This invention relates to a piston pump for compressing gas such as air. More particularly, the present invention relates to a piston pump that is compact in size and light in weight and is used in an area of a relatively low pressure. The present invention further relates to a blood pressure monitor using this piston pump.

RELATED ART

A blood pressure monitor generally includes a pump capable of sending compressed air to fasten an arm, or the like. An automated blood pressure monitor, in particular, has been widely put on the market in recent years and a diaphragm type pump has been used (for example, JP-A-63-289276). An example will be explained with reference to FIG. 32. Rotation of a rotary shaft 940 of a motor 942 is converted to reciprocating motion by a crank shaft 938 and is transmitted to a connecting rod 936 and then to a crasher 954 having a fitting portion adjusted by an iron ball 952. The crasher 954 moves up and down a diaphragm 900. When the diaphragm 900 is pulled down by the crasher 954, air is sucked from external atmosphere through a suction port (a suction port of a left side chamber is not shown) and further into the diaphragm as a valve 928 opens. When the diaphragm 900 is pushed up by the crasher 954, on the other hand, an exhaust valve 918 opens and air is discharged from a discharge port 932.

However, such a diaphragm type pump has a large number of components and needs complicated assembly processes as well as a large consumed current at a relatively low ultimate pressure. On the other hand, a piston pump in the prior art contains mechanical fastening components such as screws and springs in a similar manner as the diaphragm type pump described above, is more expensive, and does not necessarily have high efficiency at a relatively low ultimate pressure. This invention is made in view of the above needs and it is an object to provide a simple and compact piston pump having high efficiency.

DISCLOSURE OF THE INVENTION

To satisfy such needs, a piston pump according to the present invention includes a cylindrical cylinder; a piston reciprocating inside the cylinder; a suction port through which sucked gas passes when a volume of a pump chamber defined by the cylinder and the piston is changed by reciprocating motion of the piston inserted into the cylinder; an exhaust port through which discharged gas passes when the volume of the pump chamber is changed; a suction valve arranged at the suction port disposed at a top portion of the piston; and an exhaust valve arranged at the exhaust port disposed at a top portion of the cylinder.

More concretely, the present invention provides a piston pump, or the like, having the following features.

(1) A piston pump comprising: a cylindrical cylinder; a piston reciprocating inside the cylinder; a suction port through which gas sucked into a pump chamber defined by the cylinder and the piston passes; and an exhaust port through which the gas discharged from the pump chamber passes; wherein the piston pump sucks the gas through the suction port and discharges the gas through the exhaust port as the volume of the pump chamber is changed by reciprocating motion of the piston; wherein the suction port is arranged at a top of the piston with a suction valve, which opens as the volume of the pump chamber is increased; and wherein the exhaust port is arranged at a top of the cylinder with an exhaust valve, which opens when the volume of the pump chamber is decreases.

The piston pump according to the present invention includes the cylindrical cylinder, the piston reciprocating inside the cylinder, the suction port through which gas sucked into the pump chamber defined by the cylinder and the piston passes, and the exhaust port through which gas discharged from the pump chamber passes. The cylindrical cylinder may be in a so-called tubular shape such that an outside the cylinder has a shape of a circular cylinder and an inside thereof is hollow. The outside may have an entirely different shape. The piston is inserted into this cylinder. The piston preferably has an outside shape profiling the inside shape of the cylinder. The piston may reciprocate in an axial direction of the cylinder along the inner wall of the cylinder and the piston more preferably has a shape so that this reciprocating motion can be smoothly carried out.

A pump chamber encompassed by the piston (especially, a top portion (or head)), the cylinder inner wall and the cylinder top portion (or distal end portion) is defined inside the cylinder. Therefore, the volume of the pump chamber varies depending on the position of the piston in the axial direction on the cylinder side.

The gas to be sucked and discharged may be ordinary gas such as air, oxygen, nitrogen, and carbon dioxide, or may be that which is subject to phase changes depending on conditions such as vapor and freon, or a mixture thereof, or that mixed with solid substance such as a particle. Furthermore, not only the gas but also fluid such as liquid can be applied to the piston pump according to the present invention. Suction and discharge to and from the pump chamber is mainly conducted in association with the change of the volume of the pump chamber, and the suction port and the exhaust port through which the gas sucked and discharged passes are arranged in at least one element forming the pump chamber (hereinafter called "forming element"). These ports (hereinafter called "openings") may be single or plural, or one opening may operate as the suction port and the exhaust port. A plurality of openings may operate as the suction port and the exhaust port. These openings may open to the pump chamber side at least for a predetermined time or at a certain timing in each forming element in which the opening is formed.

To change the volume of the pump chamber by the reciprocating motion, to suck the gas from the suction port and to discharge the gas from the exhaust port, the piston can reciprocate while keeping predetermined air-tightness with the cylinder inner wall on which it slides. The predetermined air-tightness is air-tightness sufficient enough for the piston pump. The reciprocating motion of the piston is conducted by the driving force mainly transmitted from outside to the piston. The pressure of the pump chamber drops in comparison with the external pressure when the piston moves by the external driving force while keeping air-tightness and the volume of the pump chamber increases. Therefore, the suction valve provided to the suction port may open. The suction valve can be arranged at the top portion (or head) and/or an intermediate part or a bottom part of the piston but is preferably arranged at the top portion. For, the minimum volume of the pump chamber can be much more reduced. When the volume of the pump chamber is decreased due to the motion of the piston in the opposite direction, the exhaust valve provided to the exhaust port may open. This exhaust valve may be arranged at the top portion (or distal end or head) of the cylinder.

In this way, when the suction port having the suction valve is arranged at the top of the piston and the exhaust port having the exhaust valve is arranged at the top of the cylinder, arrangement efficiency can be improved in comparison with the case where both suction port and exhaust port are arranged at the top of the piston (or at the top of the cylinder) and the diameters of the cylinder and the piston can be decreased.

The flow of the gas is likely to become unidirectional and a smooth flow can be expected. When the cylinder top portion is flat and the top portion of the piston is flat, too, for example, mutual interference does not easily occur when the piston exists at the upper dead point and the minimum pump chamber volume can be kept small. Eventually, the compression ratio can be increased even at the same stroke. The suction port and the exhaust port described above may be mere holes (or ports) inclusive of circular openings formed in a flat plate. They may be formed by a section of a hose, a tube, a pipe, and so forth. Though the suction valve and the exhaust valve are not limited, a flap valve or the like is suitably used and other valves of arbitrary types can be used, too. For example, a part of the periphery of a flat, flexible sheet-like valve is fixed in a hinge form and opening/closing of the valve may be conducted. It is also possible to use a valve having an umbrella shape and opened/closed due to flexibility of the umbrella surface.

(2) The piston pump according to (1), wherein the suction valve is arranged on a side of the pump chamber.

The arrangement in which the suction valve is arranged on the pump chamber side may represent a valve that is arranged on the pump chamber side of the piston, whose suction port is closed when the suction valve comes into close contact with the piston and is opened when force that separates the suction valve from the piston acts. For example, it is the case where the suction valve is arranged at the top portion of the piston and is arranged on the pump chamber side of the wall forming the top portion. More specifically, when a flap type valve is arranged on the pump chamber side of the wall forming the top portion of the piston and is so disposed as to cover the suction port formed in the wall forming the top portion, the suction valve can be opened without using a high control technology, in particular, when the pump chamber is at a lower pressure than the external pressure and can be closed when the pump chamber is at a higher pressure than the external pressure. Here, the external pressure may mean the pressure or the space on the opposite side to the pump chamber side of the suction port or the atmospheric pressure or may mean the pressure or the space on the feeding side of the gas to be sucked.

(3) The piston pump according to (1) or (2), wherein the exhaust valve is arranged on an opposite side to the pump chamber of the top of the cylinder.

The arrangement in which the exhaust valve is arranged at the top portion of the cylinder on the opposite side to the pump chamber may mean that the exhaust valve is arranged at the top portion of the cylinder and is arranged on the wall forming the top portion on the opposite side to the pump chamber. Here, the top portion of the cylinder is preferably a portion that forms one of the ends of the cylinder in the axial direction. The axial direction is more preferably a direction extending along the direction of the reciprocating motion of the piston. The top portion of the cylinder is preferably a member that closes one of the ends of the cylinder and is more preferably a member that forms a plate or a wall.

When the flap type valve is arranged on the opposite side of the wall forming the top portion of the cylinder to the pump chamber side and the valve is so installed as to cover the exhaust port, the exhaust valve can be closed without using a particularly high control technology when the pressure of the pump chamber becomes lower than external air. When the pump chamber reaches a higher pressure than external air, the exhaust valve can be opened. Here, the external air may mean the space or the pressure of the exhaust port on the opposite side to the pump chamber side and may mean the space or the pressure on the feed side of the gas to be exhausted. As described above, because the suction valve and the exhaust valve operate in the interlocking arrangement, the pump can be efficiently operated.

(4) The piston pump according to any one from (1) to (3), wherein the piston has an opening communicating with the suction port on an opposite side to the pump chamber, wherein the opening is arranged so as to allow air sucked through the suction port into the pump chamber to pass and a plenum capable of storing the air to communicate with the opening; and wherein the plenum is encompassed by an enclosure having at least one plenum suction port.

Here, the plenum may include a space such as the air chamber. The opening portion communicating with the suction port may be open to the plenum so as to be allowed to suck air from the plenum. This plenum is encompassed by an enclosure being composed of one or a plurality of walls, and such an enclosure may define the principal portions of the plenum. The shape of the enclosure may include a rectangle, a circle or their combination and a so-called boxed shape can encompass the plenum. The plenum suction port may be an opening formed in the plenum. For example, the plenum suction port may include an opening portion formed in the enclosure of the plenum. A valve that can be opened and closed may be disposed in this opening portion.

(5) A piston pump including a cylindrical cylinder having a top portion; a piston reciprocating inside the cylinder; a suction port through which gas sucked into a pump chamber defined on a side of the top portion of the cylinder by the cylinder and the piston passes; and an exhaust port through which the gas discharged from the pump chamber passes; wherein the piston pump sucks the gas from the suction port and discharges the gas through the exhaust port as a volume of the pump chamber is changed by reciprocating motion of the piston; wherein the suction port is arranged at the top portion of the cylinder with a suction valve, which opens when the volume of the pump chamber is increased; and the exhaust port is arranged at the piston with an exhaust valve, which opens when the volume of the pump chamber is decreased.

(6) The piston pump according to (5), wherein the suction valve is arranged on a side of the pump chamber.

(7) The piston pump according to any one from (1) to (6), wherein the piston engages with a coupling member in such a manner that the coupling member is capable of turning in a circumferential direction thereof, and wherein the coupling member is connected to a connecting member driven such that the engaged piston is reciprocated inside the cylinder.

The piston may be connected to the connecting member through the ring-like coupling member capable of rotating in the circumferential direction of the piston. Being capable of turning in the circumferential direction of piston may represent the state where the coupling member is capable of turning clockwise and/or counterclockwise. The turning may be turning of one round or partial turning. The coupling member may be a member that connects the piston and the connecting member and transmits mechanical force from the connecting member to the piston while keeping a predetermined degree of freedom with the piston. The coupling member may include a coupling member (inclusive of a coupling ring of later-appearing embodiments) disposed on the side other than the top portion (that is, end portion of piston positioned on pump chamber side), for example, the base bottom side (that is, the side corresponding to far side from pump chamber), and capable of rotating in the circumferential direction of the piston (for example, in circumferential direction when piston is a circular cylinder piston). The connecting member (which may include a connecting ring in later-appearing embodiments) connected to this coupling member may be driven by external driving force. This external driving force may include any kind and is not limited. For example, it may be driving force by a crank shaft connected to a motor shaft. The crank shaft converts the rotary motion to the reciprocating motion.

(8) The piston pump according to (7), wherein the piston comprises therein a recess portion formed continuously in the circumferential direction of the piston and engaged with the coupling member, the recess portion including at least a part of a first predetermined spherical surface; wherein the coupling member has a projection portion formed continuously in the circumferential direction such that the projection portion corresponds to the recess portion, the projection portion including at least a part of a predetermined second spherical surface to engage with the recess such that the projection portion is capable of turning in the circumferential direction and in an axial direction; and wherein the piston reciprocates when the projection portion and the recess portion engage with each other so as to transmit driving force from the connecting member to the piston.

The inside of piston may include the side that does not face the inner wall of the cylinder. In a piston having a circular cup-like shape one of the ends of which is closed, for example, the term may include the inside of the cup or the cylindrical hollow portion. The inside recess portion may contain a groove that is recessed to a portion corresponding to the inner wall of the cup. The recess of this recess portion more preferably has substantially the same radius of curvature as that of a spherical surface formed when a ball is inscribed with the inside of the cup. The projection portion of the coupling member more preferably has substantially the same radius of curvature as that of a spherical surface that is substantially the same, or a little smaller, so that the recess portion can be engaged. The recess portion and/or the projection portion are more preferably continuous in the circumferential direction of the piston.

(9) The piston pump according to any one from (1) to (8), wherein at least a portion of the piston sliding on an inner wall of the cylinder is composed of a self-lubricating material.

The construction in which at least a portion of the piston sliding on the inner wall of the cylinder is formed of a self-lubricating material may be a construction in which a member formed of such a self-lubricating material is disposed on the inner wall side of the cylinder, that is, around the outer periphery of the piston. The construction may include a construction in which the self-lubricating material is coated around the outer periphery of the piston. The self-lubricating material need not always be disposed around the entire outer periphery but may be disposed partially. To make the lubricating performance uniform in the peripheral direction, the material is preferably arranged in the entire outer periphery and may be arranged in a single or a plurality of layers such as a belt wound on the piston, whenever necessary. The self-lubricating material has by itself the self-lubricating property and may be a mixture of the self-lubricating material with a lubricant in other cases, and they can be used appropriately without limitation. It is possible, for example, to use a composite material of an organic solid lubricant such as Teflon (registered trade mark) and an inorganic solid lubricant such as molybdenum disulfide and graphite. Furthermore, a lubricant impregnated with a liquid such as oil or silicon may be suitably used. Polymer materials and synthetic resins explained in later-appearing embodiments may also be included. These materials can be used for the piston, the cylinder, the piston head, the cylinder head, the coupling member, the connecting member, the crank shaft, the housing and other components.

The materials excellent in the sliding performance can be used not only for the piston but also for other members (for example, the cylinder, the coupling member, the connecting member, etc) and their counter-part members. It is preferred to use the material described above for both of them depending on the sliding condition. Not only the material but also the surface characteristics (surface coarseness, for example) of the material are sometimes important.

(10) The piston pump according to any one from (1) to (9), wherein the cylinder comprises a top plenum defined by a top enclosure fixed to the top portion of the cylinder and a motor housing fixed at a position spaced apart by a predetermined distance from the top portion such that the cylinder is connected and fixed to at least a part of the motor housing; wherein the motor housing is composed of a base portion fixed to the cylinder such that the base portion holds a motor for driving the piston so as to reciprocate inside the cylinder and a cover portion disposed along the base portion such that the cover portion fastens the motor by sandwiching the motor with the base portion; and wherein the cover portion and the base portion are engaged with a connecting mechanism capable of engagement and disengagement.

The top enclosure may include closure members (which may include cylinder head or head plate, for example) of the top portion of the cylinder and walls encompassing the top plenum. For example, the top enclosure may include the enclosure member described above as a base material, side walls having a predetermined height and extending substantially vertically on and over the base material and a ceiling plate expanding substantially parallel to the base material on the side walls. The top plenum may include a space such as an air chamber. The top enclosure may include an exhaust or discharge port opening to the outside of a piston pump system and communicating with the plenum. This discharge port may take a tubular shape as a discharge port. A portion spaced apart by a predetermined distance from the top portion of the cylinder may exist at a position a little spaced apart from the top portion along the cylinder. In other words, the motor housing is more preferably fixed to the cylinder but not directly to the cylinder top portion. When the cylinder is used as a structure, the weight or size of the overall piston pump can be reduced. Therefore, the motor housing is fixed to the cylinder and the motor fixed to this motor housing is fixed to the cylinder.

(11) The piston pump according to any one from (1) to (10), wherein the piston pump is connected to a blood pressure monitor.

(12) A piston pump in which a piston reciprocates inside a cylinder having a cylinder head for pressurization, the piston pump is characterized in that:

<1> an inner diameter of the cylinder is not exceeding approximately 20 mm;

<2> a throughput of the piston pump is not exceeding approximately 6.0 liters/min;

<3> pressurization characteristics thereof can be maintained even after approximately 10,000 reciprocating motions of the piston; and <4> the cylinder and the cylinder head are non-mechanically coupled.

The construction in which <1> the inner diameter of the cylinder is equal to or not greater than approximately 20 mm in the piston pump that reciprocates inside the cylinder having the cylinder head and conducts pressurization may be a construction in which the inner diameter of the cylinder used as a main component of the piston pump is equal to or not greater than approximately 20 mm. More preferably, the cylinder inner diameter of a pump for a wrist blood pressure monitor is equal to or not greater than approximately 8.5 mm and the cylinder inner diameter of an upper arm blood pressure monitor is equal to or not greater than approximately 18 mm. Here, the cylinder head may represent a member (inclusive of component) at the cylinder top portion and may include a member (inclusive of component) directly bonded to the member of the cylinder top portion. The size of the piston pump according to the present invention can be made compact due to its structure and its component structure. The construction in which <2> the discharge throughput of the piston pump is equal to or not greater than approximately 6.0 liters/min may represent that the discharge throughput when the pump is operated under a non-loaded condition is equal to or not greater than approximately 6.0 liters/min. More preferably, the discharge throughput of the piston pump is equal to or not greater than approximately 1.0 liter/min in the case of a wrist type pump and is equal to or not greater than approximately 5.5 liters in an upper arm type pump. The construction in which <3> pressurization characteristics can be maintained even by reciprocating motion of the piston of approximately 10,000 times may represent that predetermined performance of the piston pump such as a maximum ultimate pressure and/or a pressure ultimate speed can be maintained even when the piston is reciprocated approximately 10,000 times. More preferably, the pressurization characteristics can be maintained even by the reciprocating motion of the piston of at least approximately 30,000 times. The construction in which <4> the cylinder and the cylinder head are non-mechanically coupled may represent that the cylinder head formed by bonding the valve plate and the manifold constituting the end face of the top portion of the cylinder and the cylinder are coupled by a non-mechanical method such as adhesion, welding (metal), welding (plastic), and the like. Bonding is particularly preferably made by welding (metal) and/or welding (plastic). The cylinder and the cylinder head may well be bonded by welding (metal) and/or welding (plastic) without using screws or fitting using springs. According to such a construction, seal performance can be easily secured and the pump can be rendered compact. For, when mechanical bonding members such as the screws are used, it is necessary in some cases not only to bore screw holes or to secure spaces for screw threads but also to use screws capable of securing air-tightness.

(13) A method of producing a piston pump including a cylindrical cylinder, a piston reciprocating inside the cylinder; a suction port through which gas sucked into a pump chamber defined by the cylinder and the piston passes and an exhaust port through which the gas discharged from the pump chamber passes; the method comprising the steps of: producing a piston pump pre-assembly comprising the cylinder and a cylinder top portion in which the exhaust port is formed; conducting a leakage inspection of the piston pump pre-assembly; and producing a piston pump by further assembling components to the piston pump pre-assembly.

The piston pump pre-assembly may include the cylinder and the cylinder top portion in which the exhaust port is formed, and may be a semi-finished product of the piston pump containing those components which are necessary for conducting a leakage inspection of the piston pump. The step of forming this piston pump pre-assembly does not require assembly using screws and springs. In other words, the production of the piston pump pre-assembly may be carried out by conducting combination inclusive of butting of components and assembling and conducting non-mechanical bonding such as adhesion, adhesion, welding (metal), welding (plastic) and so forth. The leakage inspection of the piston pump pre-assembly is necessary for the piston pump but need not always be made for the finished product of the piston pump. The production of the piston pump by further assembling components to the piston pump pre-assembly may mean that those components which are once removed from the piston pump pre-assembly in the subsequent step of finishing the piston pump need not be assembled again.

The piston pump to be connected to the blood pressure monitor may represent a piston pump that is exclusively used for an instrument for measuring the blood pressure. However, the piston pump does not exclude other applications and may include the application of the measurement of the blood pressure. The piston pump used for the instrument for measuring the blood pressure may include a pump for generating an air pressure necessary for pressing (fastening) the portion necessary for the blood pressure measurement such as the wrist or the arm of people.

(14) A blood pressure monitor utilizing the piston pump according to any one from (1) to (12).

DESCRIPTION OF THE PREFERRED EMBODIMENT

The present invention will be hereinafter explained in further detail about an embodiment thereof with reference to the drawings. The embodiment represents concrete component names, materials, numerical values, etc, as a preferred example of the present invention but the present invention is not limited to the embodiment.

Figure 1:
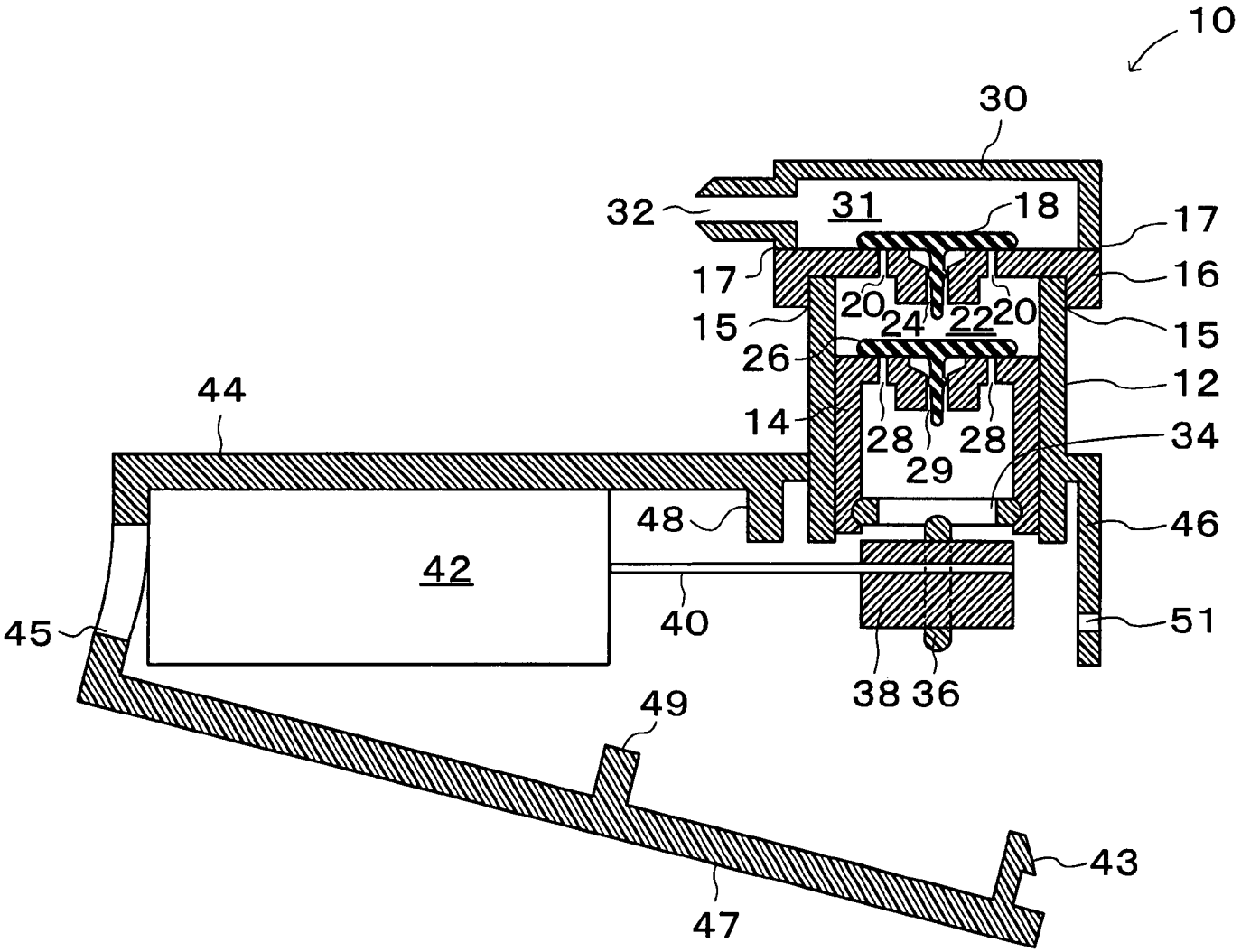
FIG. 1 is a view showing in section a piston pump according to an embodiment of the present invention under the state where a motor housing is open.

FIG. 1 is a sectional view of a piston pump 10 according to an embodiment of the present invention. The piston pump 10 of this embodiment mainly comprises a housing for accommodating a motor 42, constituted by a housing substrate material 44 and a cover 47, a piston 14 driven by the motor 42, a cylinder 12 into which the piston 14 is inserted and a valve plate 16 forming a cylinder top portion, and a manifold 30 welded to the valve plate 16. The motor 42 positioned at a lower left position in the drawing is supported by the cover 47 in such a manner as to strike the lower part of the housing substrate material 44. A degree of freedom of the motor 42 in a transverse direction in the drawing is restricted by an upward protuberance 49 formed at a substantial center of the cover 47 and the degree of its freedom in a rotating direction is restricted as the motor 42 is sandwiched between the housing substrate material 44 and the cover 47. The cover 47 is connected by a side member 45 playing the role of a hinge in such a manner as to hang down from the housing substrate material 44. The cover 47 closes the housing by sandwiching the motor 42 with the housing substrate material 44 as described above and fixes the motor 42 inside the housing. At this time, a protuberance 43 on the right side of a protuberance portion extending upward at the extreme right of the cover in the drawing engages with an opening 51 formed at a lower part of a side member 46 existing at a position opposing the side member 45 to prevent the cover 47 from falling down in the drawing and to keep it under the closed state. The cylinder 12 is positioned on the right side in the drawing, is coupled and fixed with the housing (particularly, the housing substrate material 44) and extends vertically in the drawing. The piston 14 is inserted into the cylinder 12 and reciprocates in an axial direction that is the vertical direction in the drawing. The valve plate 16 is bonded to and arranged on the cylinder 12 in the drawing by welding portion 15 so as to keep gas-tightness and forms the top portion of the cylinder 12. The valve plate 16 has the manifold 30 that is welded to a welding portion 17 at the upper part in the drawing. A space 31 defined by the manifold 30 and the valve plate 16 is a chamber for air exhausted and the welding portion 17 is welded in such a manner as to keep air-tightness of this chamber. In other words, the space 31 functioning as a top plenum is defined by the valve plate 16 and the manifold 30 that together function as a top enclosure. An air outlet (discharge port 32) of the chamber constituted by the space 31 is disposed on the left side of the manifold 30 in the drawing.

Figure 8:
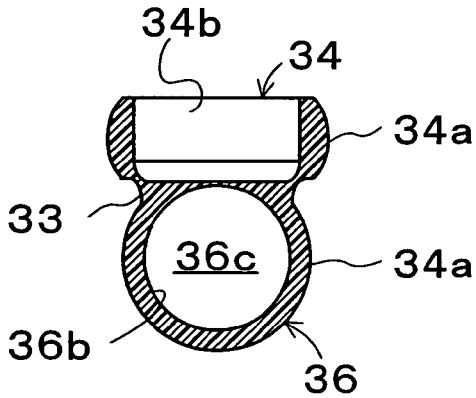
FIG. 8 is a sectional view of the connecting ring as a component of the piston pump according to the embodiment of the present invention.
Figure 9:
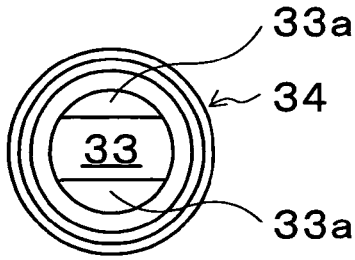
FIG. 9 is an upper surface view of the connecting ring as a component of the piston pump according to the embodiment of the present invention.
Figure 10:
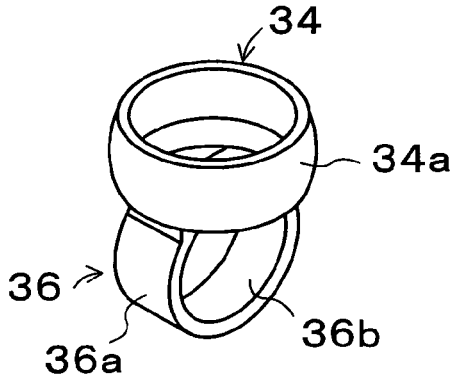
FIG. 10 is a perspective view of the connecting ring as a component of the piston pump according to the embodiment of the present invention.
Figure 11:
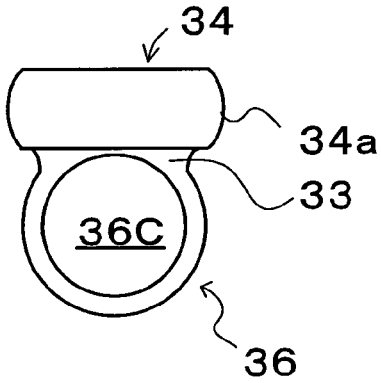
FIG. 11 is a front view of the connecting ring as a component of the piston pump according to the embodiment of the present invention.

The rotation of the driving shaft 40, that extends to the right in the drawing, of the motor 42 accommodated in the housing is transmitted to the crank shaft 38 pressure-fitted into the driving shaft 40. Because the driving shaft 40 is press-fitted to the position deviated by a predetermined distance L from the center of the crank shaft 38 having a cylindrical shape, however, the rotary motion is converted to the reciprocating motion in the vertical direction (see FIG. 2). The crank shaft 38 is so fitted into the ring opening portion 36*c* (see FIG. 8) of the connecting ring 36 as to be capable of rotating. The outer periphery of the crank shaft 38 slides with the inner surface of the open portion of the connecting ring 36 when the crank shaft 38 rotates. For, the connecting ring 36 is fixed in the rotating direction described above and cannot follow and rotate. The driving shaft 40 is eccentrically connected to the crank shaft 38, the axial position of the driving shaft 40 is fixed by a bearing of the motor 42 and the motor 42 is fixed to the housing. Therefore, the connecting ring 36 changes its position relative to the housing, that is, relative to the fixed cylinder 12 but is restricted by the coupling ring 34 formed integrally with the connecting ring 36, the piston 14 to which the coupling ring 36 is connected and the inner wall of the cylinder 12 into which the piston 14 is fitted, thereby causing the reciprocating motion of the piston. The coupling ring 34 integrally bonded with the connecting ring 36 absorbs to a certain extent the motion of the connecting ring 36 due to the crank shaft 38 in the foreground and depth sides of the drawing by freedom of the coupling ring 34 in the piston circumferential direction and by the spherical outer peripheral surface of the coupling ring received by a spherical seat 37 of the piston inner surface in the circumferential direction and transmits this motion to the piston 14 as the vertical reciprocating motion in the drawing (see FIG. 4). In other words, the rotation of the motor 42 allows the piston 14 fitted into the cylinder 12 to reciprocate in the vertical direction in the drawing.

When the piston 14 is pulled down in the drawing, the volume of the pump chamber 22 defined by the top portion of the piston 14, the inner wall of the cylinder 12 and the valve plate 16 at the top of the cylinder increases and the pressure inside the pump chamber 22 drops. Consequently, an umbrella-shaped suction valve 26 inserted into a hole 29 formed at the center axis position of the piston 26 opens and air is introduced through the suction port 28 from the external atmosphere below the piston 14. The coupling ring 34 has a ring-like shape and its center portion is hollow with the exception of the connection portion with the connecting ring 36. Therefore, air sucked from the suction port 28 comes from the hollow portion 35 of the piston 14 (see FIG. 4). This air passes through the spaces on both of the sides (or one of the sides) of the connection portion of the coupling ring 34 pressure fitted into the piston 14 and from the lower side (or the base bottom side) of the piston 14. The crank shaft 38, etc, is arranged and accommodated in the housing (housing substrate material 44, side members 45 and 46 and cover 47) below the piston 14 but has sufficient opening because a partition plate 48 has openings. Consequently, air can be sucked substantially freely from below the piston pump 10. Incidentally, FIG. 1 shows the state where the piston 14 is pulled down almost to the lower dead point.

The volume of the pump chamber 22 decreases while the pressure inside the pump chamber 22 increases when the piston 14 is pulled up in the drawing. Therefore, air having a high pressure inside the pump chamber opens the umbrella-shaped exhaust valve 18 fitted into the hole 24 disposed at a position of the valve plate 16 corresponding to the cylinder center axis and arranged at the top (or distal end portion) of the cylinder 12 through the exhaust port 20 opened by the valve plate 16 arranged at the top (or distal end portion) of the cylinder 12. Air inside the pump chamber is from thence exhausted. Air so exhausted is discharged from the discharge port 32 through the space 31 inside the manifold.

In the embodiment, the portions that frequently slide are a set of the crank shaft 38 and the connecting ring 36 and a set of the piston 14 and the cylinder 12. To satisfy their sliding characteristics, an organic material such as a synthetic resin is preferably used and its surface coarseness is as small as possible and is preferably a mirror surface or approximate to the mirror surface. More concretely, the crank shaft 38, the connecting ring 36 and the piston 14 of this embodiment use "Lubmer" (registered trade mark) of Mitsui Petrochemical Co., Ltd. This Lubmer is a specific polyolefin resin having high sliding characteristics. It is also possible to use ultra-high molecular weight polyethylene (for example, "Hizex Million", a product of Mitsui Petrochemical Co., Ltd), polyacetal and nylon (6, 66) as the sliding member besides the specific polyolefin resin described above. In this embodiment, the cylinder 12, the valve plate 16 and the manifold 30 that are integral with the housing are formed of a polymer material comprising "Stylac" (registered trade mark) of Asahi Kasei K. K. These components are made of the same ABS in view of their weldability The valve uses an ordinary NBR rubber.

Each bonding member shown in the drawings is bonded by the ultrasonic welding at each welding portion.

Figure 2:
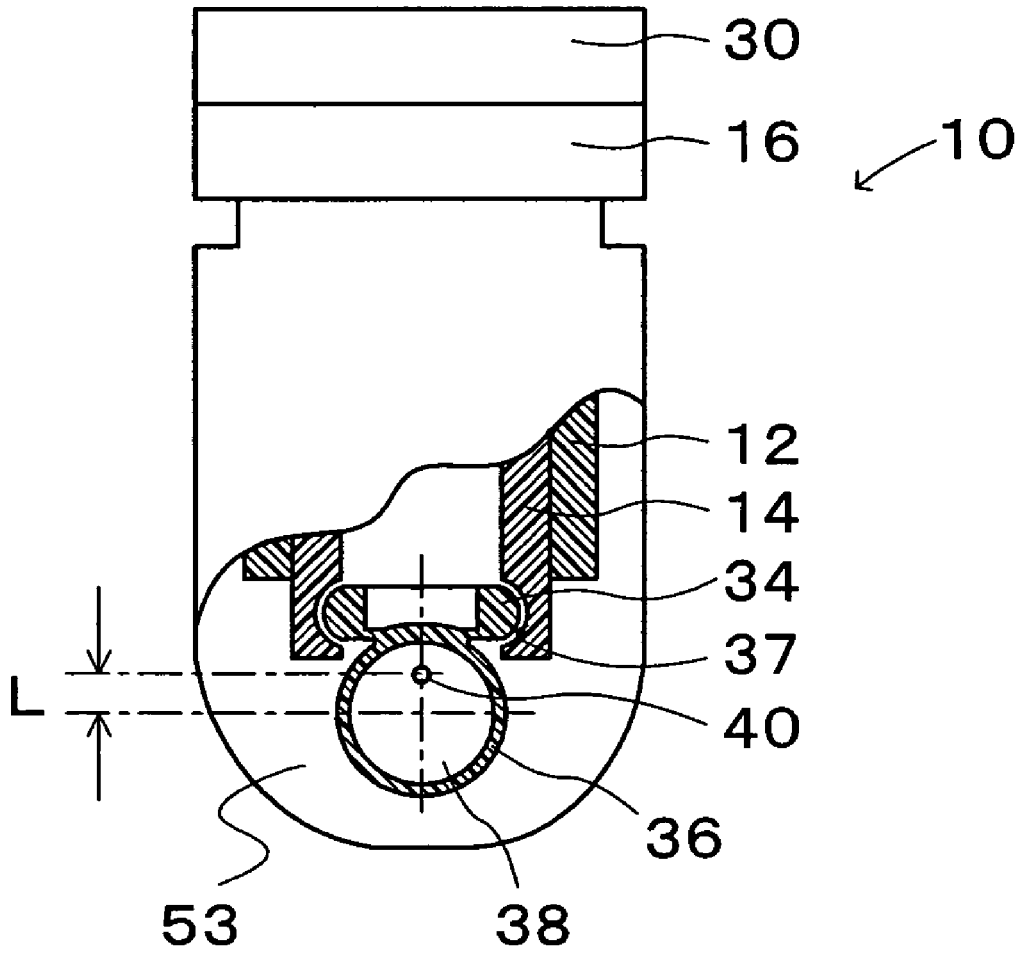
FIG. 2 is a view showing the piston pump according to the embodiment of the present invention under the state where a side surface of the piston pump is partially shown in section by removing a part of components.

FIG. 2 is a partial sectional view of the piston pump of the embodiment when a part of the components viewed from the right side of FIG. 1 is removed. The uppermost rectangular component is the manifold 30. The manifold 30 and the valve plate 16 below the former are bonded to each other by ultrasonic welding capable of keeping air-tightness in the same way as bonding between the cylinder 12 integrated with the housing below the valve plate 16 and the valve plate 16. The piston 14 inserted into the cylinder 12 has the suction port 28 and the suction valve 26 (see FIG. 1). The spherical seat 37 exists in the recess portion formed in the inner peripheral surface of the piston 14 below the piston 14 (see FIG. 4). The spherical seat 37 is finished into the annular spherical shape so that it mates with the convex outer circumference of the coupling ring 34 that is brought into contact with the spherical seat 37. The coupling ring 34 is press-fitted into this recess. The convex of the coupling ring 34 and the upper and lower tilt portions of the recess in which the coupling ring 34 exists and the coupling ring 34 move up and down the piston 14 without falling off from this recess. The position of the driving shaft of the motor 42 does not change with respect to the housing in the drawing. Therefore, the connecting ring 36 moves up and down and to the right and left in the drawing with respect to the housing when the motor 42 rotates. When moving up and down, the connecting ring 36 simultaneously moves up and down the piston 14. When the connecting ring 36 moves to the right and left, however, the connecting ring 36 undergoes deformation at the joint portion with the coupling ring 34 because the cylinder 12 restricts the movement of the connecting ring 36. It is therefore possible to absorb this motion, or to absorb this motion with the coupling ring 34 due to the slip in the spherical seat 7. Because the coupling ring 34 has freedom to a certain extent in its circumferential direction, it can absorb the movement of the driving shaft 40 of the motor 42. Therefore, the piston pump can flexibly cope with unexpected movement and deformation of the piston 14 and the crank shaft 38 because freedom for absorbing the movement is secured in various directions.

Figure 3:
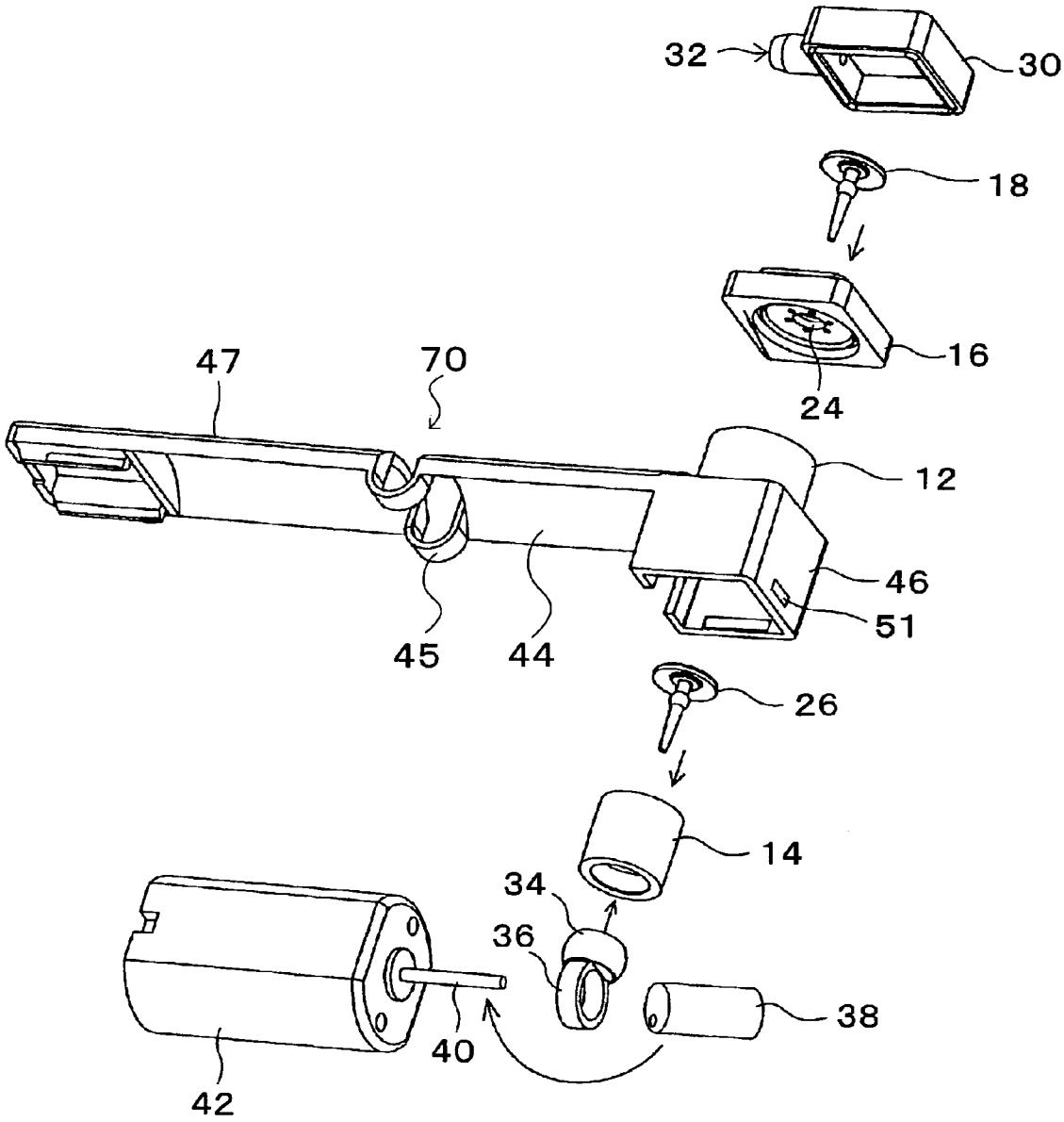
FIG. 3 is an expanded view of the piston pump according to the embodiment of the present invention when the piston pump is expanded into components.

FIG. 3 is a view when the piston pump 10 of the embodiment is expanded into each component. The piston pump 10 serially includes, from above, the manifold 30 having the discharge port 32, the valve 18 as the exhaust valve inserted into the hole 24 of the valve plate 16, the valve plate 16 bonded to the manifold 30 by ultrasonic welding, the cylinder 12 having this valve plate 16 as its top (or distal end portion), the housing (housing substrate material 44, cover 47, side members 45 and 46) integrally including the cylinder 12, the valve 26 inserted into the center hole of the piston 14 and operating as the suction valve, the piston 14 inserted into the cylinder 12, the coupling ring 34 press-fitted into the spherical seat 37 as the recess of the lower part (or base bottom side) of the inside of the piston 14 and transmitting the driving force of the reciprocating motion to the piston 14, the connecting ring 36 integrally coupled with the coupling ring 34, the crank shaft 38 inserted to the inner circumference of the connecting ring 36, the driving shaft 40 pressure fitted into the crank shaft and driven for rotation and the motor 42 for driving the driving shaft 40. As can be seen clearly from the drawing, the components are mainly connected and assembled in the vertical direction in the drawing and assembly itself is extremely simple and easy. Therefore, this piston pump can be made compact in scale. Furthermore, mechanical fastening members (screws, rivets, bolts and nuts, nails, etc, for example) that have ordinarily been used for assembling these components are not necessary. In other words, it can be the that assembly is made by using non-mechanical fastening members. Assembly by using non-mechanical fastening members may mean bonding by bonding, deposition, welding, etc and assembly such as press-fitting, fitting, insert molding, insertion, etc (inclusive of detent of assembly component itself, latch mechanism by engagement member). The assembly step becomes short in time and production efficiency is high because assembly is made by such non-mechanical fastening members. In this embodiment, the manifold 30, the valve plate 16 and the cylinder 12 are bonded by ultrasonic deposition, respectively. The valve 18 and the valve plate 16, the valve 26 and the piston 14, the piston 14 and the coupling ring 34, the connecting ring 36 and the crank shaft 38 and the crank shaft 38 and the driving shaft 40 can be detachably assembled by fitting, respectively.

Figure 4:
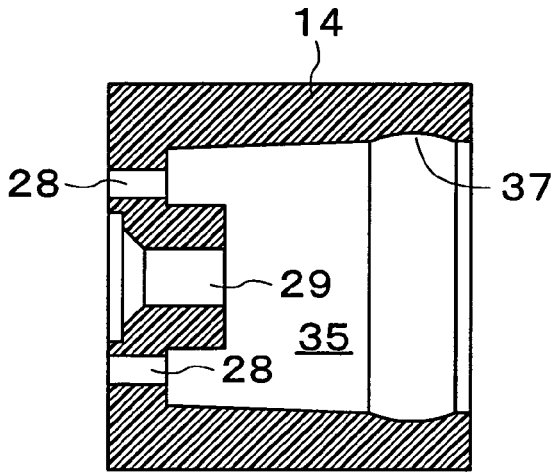
FIG. 4 is a sectional view of a piston as a component of the piston pump according to an embodiment of the present invention.
Figure 5:
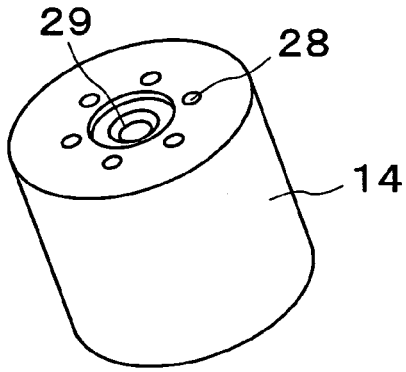
FIG. 5 is a perspective view when the piston as a component of the piston pump according to the present invention is viewed from its top.
Figure 6:
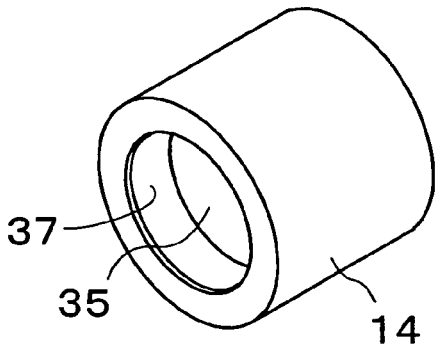
FIG. 6 is a perspective view when the piston as a component of the piston pump according to the present invention is viewed from its base bottom side.
Figure 7:
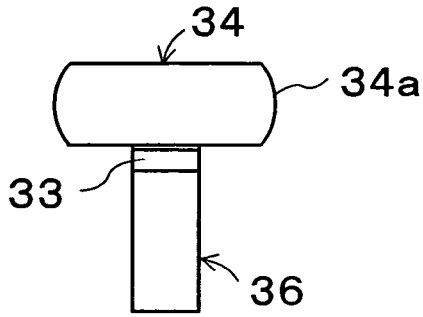
FIG. 7 is a side view of a connecting ring as a component of the piston pump according to the embodiment of the present invention.

FIGS. 4 to 6 are views for explaining in detail the piston 14. The hole 29 for fitting the valve is disposed at the center of the piston 14 in such a manner as to communicate with the hollow portion 35 inside the piston and a plurality of suction ports 28 is arranged around the hole. The umbrella portion of the valve 26 (see FIG. 3) of the valve 26 fitted into the hole 29 covers these suction ports. The recess is formed below (or base bottom side) the hollow portion 35 inside the piston and the spherical seat 37 is disposed in the recess.

FIGS. 7 to 11 show the connecting ring 36 molded integrally with the coupling ring 34 as the coupling member when the connecting ring 36 is viewed from various angles. A projection portion 34*a* is formed around the entire outer circumference of the coupling ring 34 and the curvature of this projection portion 34*a* is so set as to be capable of rotating in, or engaging rotatably with, the spherical seat 37 (see FIG. 4) existing in the recess of the piston 14. The curvature of the projection portion 34*a* is a little smaller than the curvature of the spherical seat 37, for example. In other words, the radius of curvature of the spherical seat 37 is a little greater than the radius of curvature of the projection portion 34*a*. A hollow portion 34*b* exists on the inner circumferential side of the coupling ring 34 and operates as an air passage. The coupling ring 34 and the connecting ring 36 are coupled by a coupling portion 33 and are integrally molded.

When this integral member is viewed from the upper surface, the rectangular coupling portion 33 can be seen through the hollow coupling ring 34. Gaps 33*a* are provided above and below the coupling portion 33 and operate as passages for feeding necessary air to the suction ports 28 of the piston 14. The connecting ring 36 has substantially flat outer and inner circumferential surfaces 36*a* and 36*b*. The crank shaft 38 is fitted into the ring opening portion 36*c* as the space defined by this inner circumferential surface 36*b*.

Figure 12:
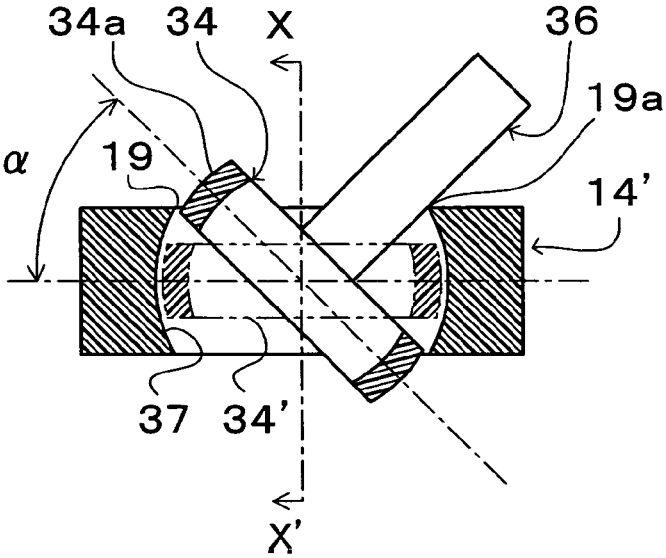
FIG. 12 is a schematic sectional view for explaining the function of the connecting ring as a component of the piston pump according to the embodiment of the present invention.
Figure 13:
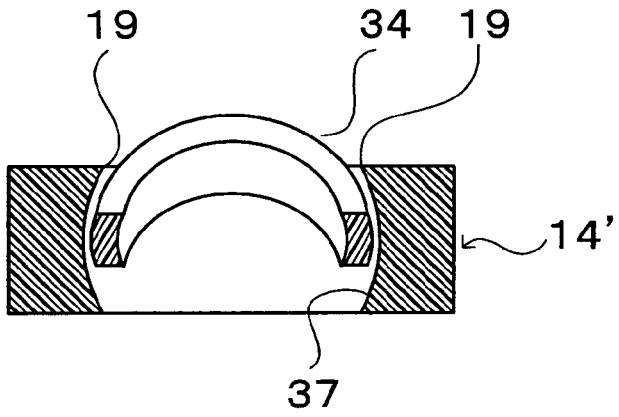
FIG. 13 is an X-X' sectional view of FIG. 12.
Figure 14:
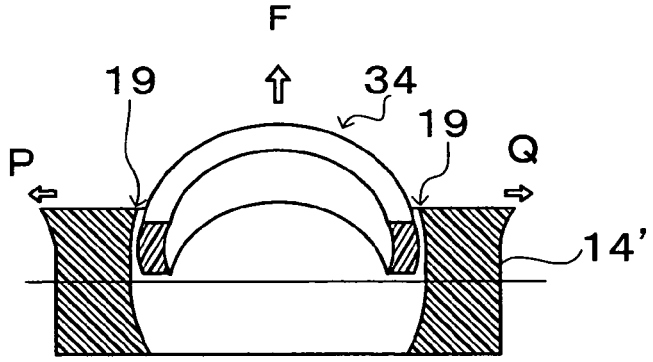
FIG. 14 is a sectional view showing deformation of a recess portion of the piston when the connecting ring shown in FIG. 13 is taken out.
Figure 15:
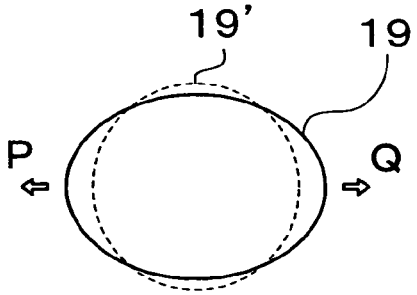
FIG. 15 is a schematic view when deformation of the recess portion of the piston shown in FIG. 14 is viewed from the base bottom side of the piston.

FIGS. 12 to 15 schematically show the mode of engagement and disengagement between the spherical seat 37 as the recess portion of the piston 14 and the projection portion 34*a* of the coupling ring 34. The coupling ring 34' that exists inside the spherical seat 37 at a substantially horizontal position when the piston is driven can rotate not only in the circumferential direction of the piston 14 but also in the direction corresponding to the movement in the axial direction as shown in FIG. 12. In the drawing, the member 14' representing schematically the base bottom portion of the piston 14 is shown upside down in the reverse way to FIG. 1. The coupling ring 34 can be pivotally rotated in this way when the connecting ring 36 protruding from the spherical seat 37 is moved back and forth and to the right and left. However, it is extremely difficult for the coupling ring 34 to fall off as such because the diameter of the opening 19 at the upper part of the member 14' schematically representing the base bottom portion of the piston 14 is sufficiently smaller than the diameter of the projection portion 34*a* of the coupling ring 34.

Therefore, to remove the coupling ring 34 from the recess portion having the spherical seat 37, the coupling ring 34 is tilted by an angle of inclination a in such a manner that at least a part of the projection portion 34*a* protrudes from the opening 19 of the member 14' schematically representing the base bottom portion of the piston 14 on the base bottom side (upper side in the drawing). Next, the connecting ring 36 is pushed with the portion 19*a* that is the edge of the opening 19 and strikes the side surface of the connecting ring 36 as the support point to allow a pulling force F for pulling out the coupling ring 34 from the opening 19 to operate. At this time, the opening 19 is expanded by the outer circumferential surface of the projection portion 34*a* in P and Q directions. Because this expanding force operates on only the portion that keeps contact in practice, the original opening 19' need not be expanded as a whole but may be sufficiently expanded so as to form an elliptic opening 19. Therefore, the pulling force F need not be much great.

Figure 16:
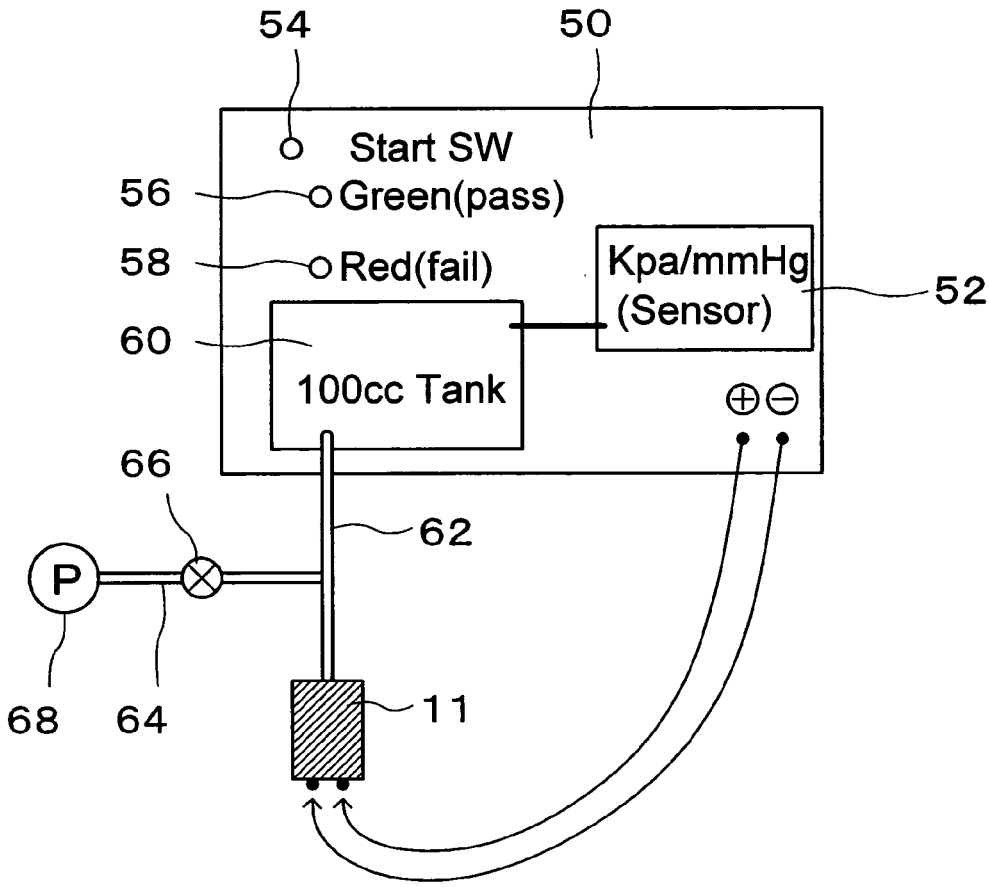
FIG. 16 shows a gas leakage inspection apparatus of the piston pump, and a method for the apparatus, according to the embodiment of the present invention.

FIG. 16 is a view for explaining a gas leakage inspection step of the piston pump according to this embodiment. The piston pump of the embodiment mainly handles a gas of a low pressure and is not considered as a pressure container. Therefore, a predetermined inspection is necessary. The greatest square in the drawing represents an inspection apparatus 50. The inspection apparatus 50 has a round start switch 54 at an upper part of a front panel and a green lamp 56 and a red lamp 58 indicating the inspection result are arranged below the start switch 54. The inspection apparatus 50 has therein a 100 cc-tank 60 (capacity is different when inspection standard is different). The tank 60 is connected to a pipe 62 extending outward. A sensor 52 is fitted to the tank 60 and measures the change of the pressure inside the tank. A power source is disposed at a lower right position of the inspection apparatus 50 and can be connected to the pump, etc, as the inspected body. A pump pre-assembly 11 as the inspection object is connected to the distal end of the pipe 62. Another pipe 64 is connected in a T shape to an intermediate part of the pipe 62. A valve 66 is arranged at an intermediate part of the pipe 64 and is connected to an external pump 68. Here, the power source is used when the inspection object can by itself make pressurization and is not particularly necessary in this embodiment because the external pump 68 conducts pressurization.

Figure 17:
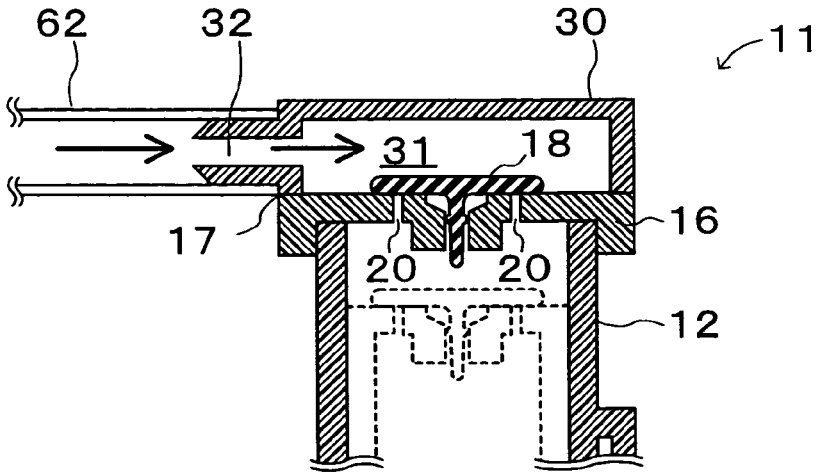
FIG. 17 is a view showing in a section a piston pump pre-assembly used for the gas leakage inspection of the piston pump according to the present invention.

FIG. 17 shows the pump pre-assembly 11 as the inspection object shown in FIG. 16. The inspection object mentioned hereby includes the valve plate 16 and the exhaust valve 18 welded to the top of the cylinder 12 and the manifold 30 welded to the valve plate 16 in the piston pump of the embodiment described above exclusive of the piston and its accessorial components and the motor and its accessorial components. Air-tightness of the space 31 defined by the valve plate 16 and the manifold 30 or the air chamber is the inspection object in the inspection and the piston, etc, need not be inspected. To carry out the inspection, the valve 66 is first opened and the pressure inside the tank is set to approximately 300 mmHg by the external pump 68 (see FIG. 16). At this time, the pump pre-assembly 11 as the inspection object may be connected so that it is not affected by the pressurization step by disposing still another valve at an intermediate part of the pipe 62. When a predetermined pressure is reached by the external pump 68, the valve 66 is closed, the start switch 54 is turned ON and the inspection is started. When the absence of leakage to a certain extent is confirmed after the passage of approximately 15 seconds, the green lamp 56 is lit and when the leakage is great, the red lamp 58 is lit. As described above, in the piston pump according to this embodiment, the inspection can be made under the state of the piston pump pre-assembly, and defective products can be rejected at an early stage and productivity can be improved.

Figure 18:
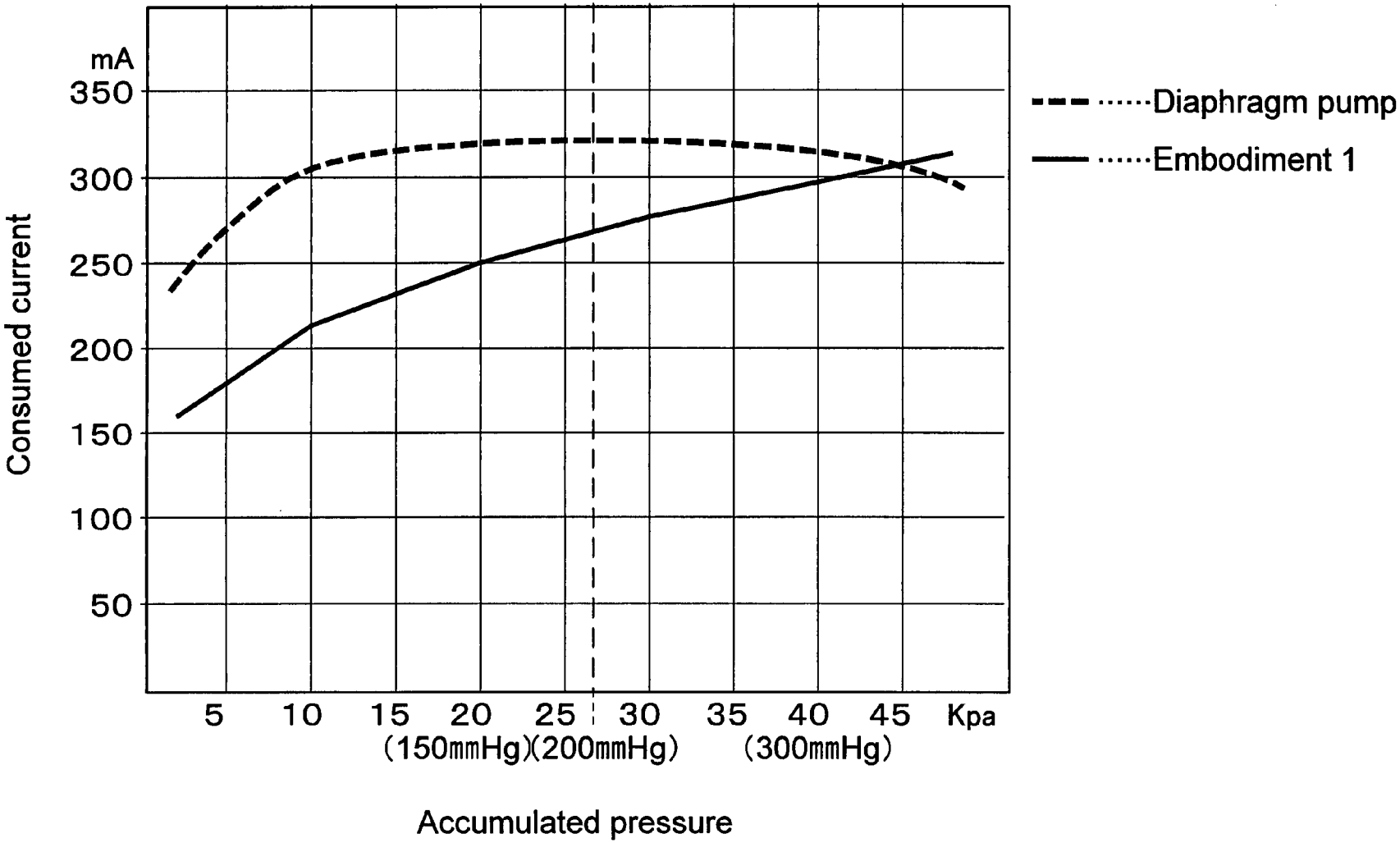
FIG. 18 is a graph showing the relation between an ultimate pressure reached by the piston pump according to the embodiment of the present invention and a consumed current.

FIG. 18 is a graph showing an ultimate pressure and consumed power when the piston pump of this embodiment is operated at a predetermined capacity (100 cc in the drawing). The result of a diaphragm pump having a similar capacity is indicated by broken line. In this graph, a large consumed current means the necessity of large power and when comparison is made at the same pressure, lower power efficiency means greater consumed power. In the piston pump according to this embodiment, the current when a pressure of approximately 5 KPa is reached is approximately 180 mA and the current value becomes greater as the pressure rises. The current value is approximately 270 mA at a pressure of approximately 27 KPa necessary for a blood pressure monitor that can be conceived as an application example of this piston pump. In contrast, in the diaphragm pump, the current value is approximately 270 mA at approximately 5 KPa and approximately 320 mA at approximately 27 KPa. In other words, it can be understood that the piston pump according to the embodiment has the advantage that it is excellent in current efficiency in a range that is used in practice.

Figure 19:
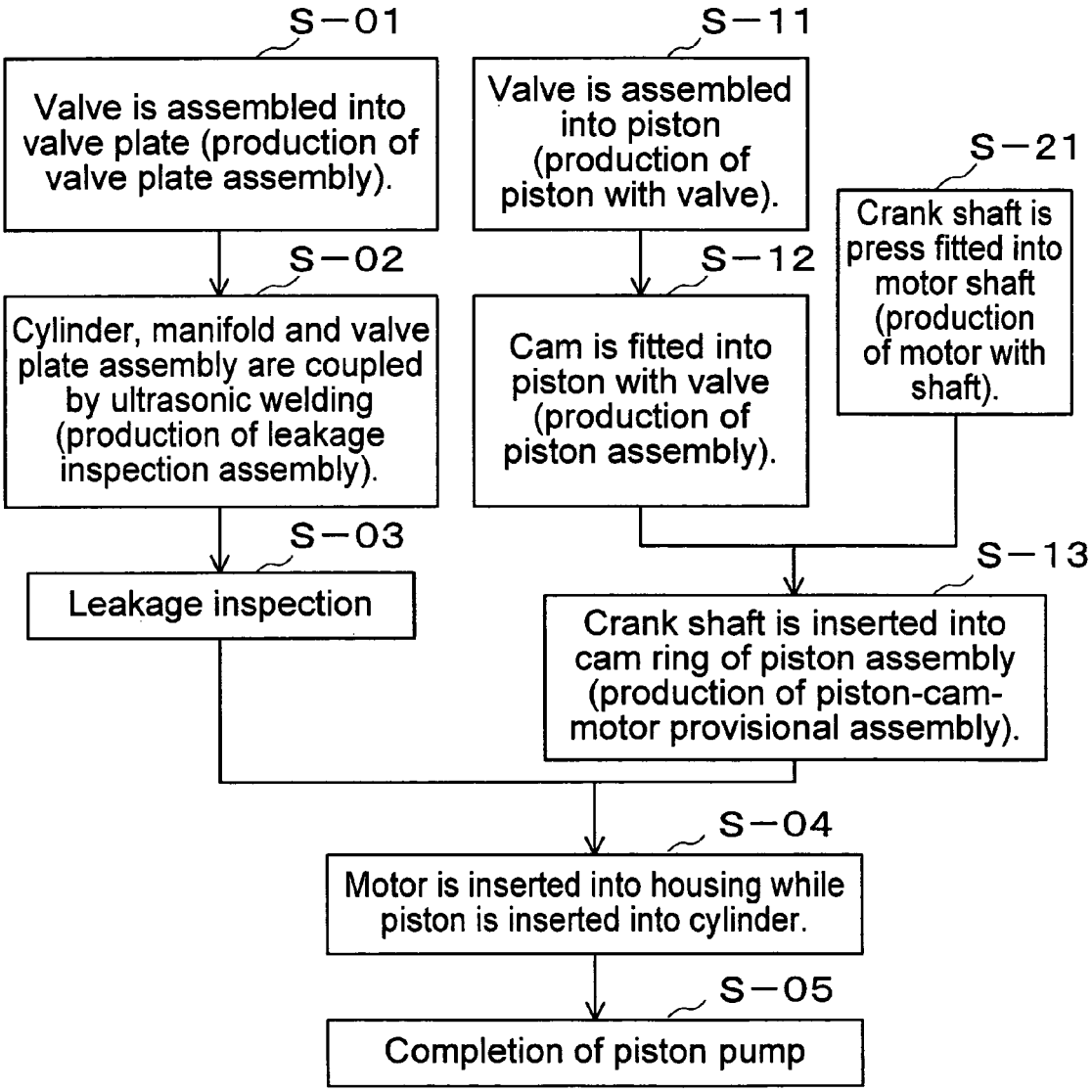
FIG. 19 is a flowchart showing a production method of the piston pump according to the present invention inclusive of a gas leakage inspection step.

FIG. 19 illustrates a production process of the piston pump according to this embodiment. First, a valve that is to become the exhaust valve 18 is fitted into the hole 24 of the valve plate 16 to fabricate a valve plate assembly (S-01). Next, the cylinder 12, the valve plate assembly and the manifold 30 are bonded by ultrasonic welded to fabricate the piston pump pre-assembly (S-02). The leakage inspection described above is carried out for this piston pump pre-assembly as the inspection object (S-03). Those inspection objects which are approved in the inspection are sent to the next step and those rejected are repaired or discarded. The piston assembly is fabricated in parallel with the steps described above. First, the valve that is to become the suction valve 26 is fitted into the hole 29 of the piston 14 to fabricate the piston equipped with the valve (S-11). Next, the coupling ring 34 having the connecting ring 36 coupled thereto is press-fitted (inserted) into the piston with the valve to fabricate the piston assembly (S-12). The crank shaft 38 is press-fitted to the driving shaft 40 of the motor 42 in parallel with the production step described above and the motor equipped with the shaft is produced (S-21). The crank shaft of the motor equipped with the shaft is inserted into the connecting ring of the piston assembly described above and a piston-cam-motor provisional assembly is produced (S-13). The piston of the piston-cam-motor provisional assembly is inserted into the cylinder of the piston pump pre-assembly described above and at the same time, the motor is fitted to the housing (S-04). The cover 47 of the housing is closed and the projection 43 is meshed with the opening 51 to complete the piston pump of this embodiment (S-05). As described above, the piston pump according to this embodiment can be produced with a drastically smaller number of production steps while the gas leakage test is inserted into the production steps.

Figure 20:
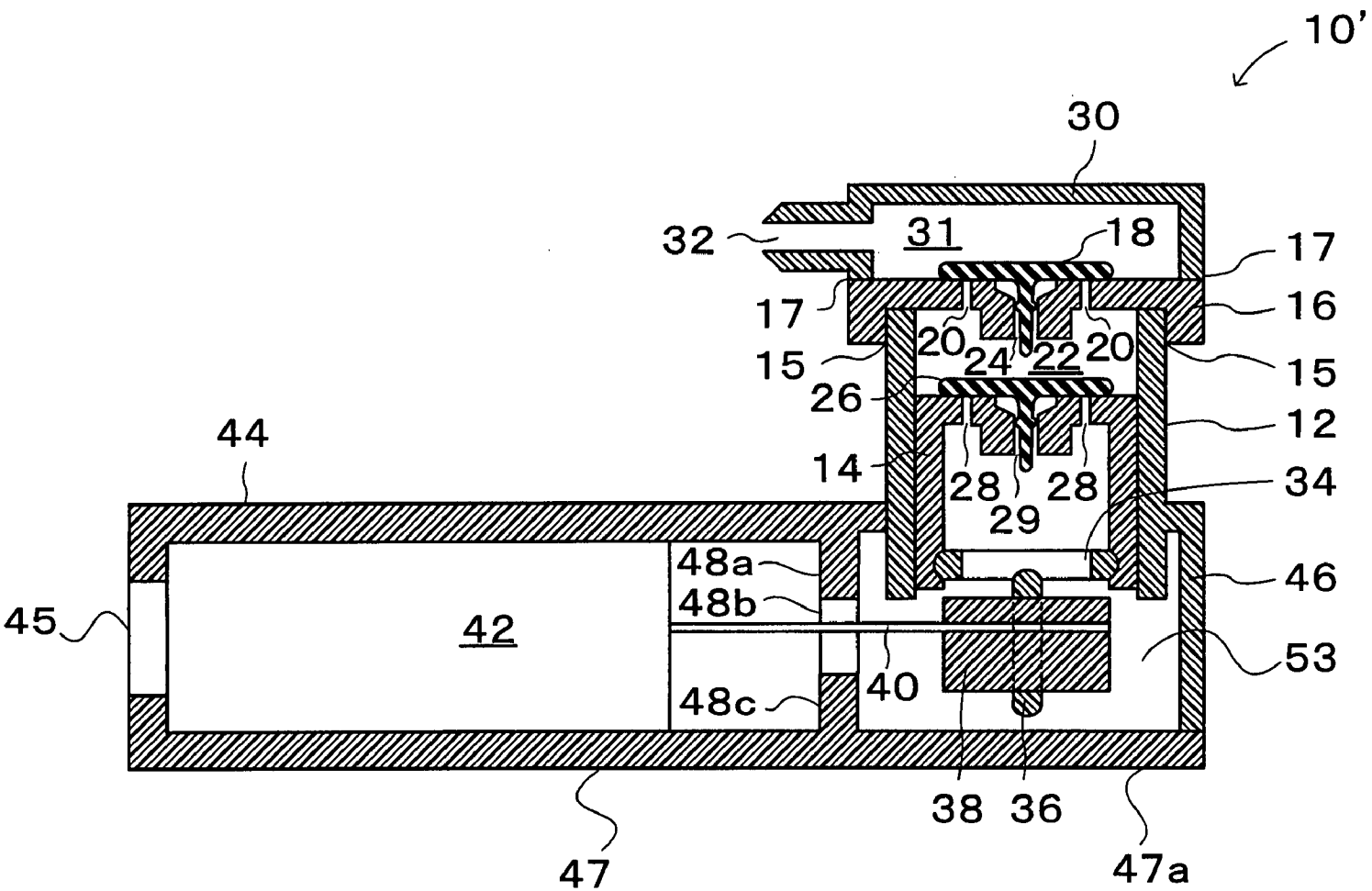
FIG. 20 shows a section of the piston pump according to the embodiment of the present invention under the state where a cover portion of the motor housing is closed.

FIG. 20 is a sectional view showing a piston pump 10' according to another embodiment. Since the basic construction is the same as the one shown in FIG. 1, common portions are omitted. The cover 47 is closed and the plenum 53 is defined by the right side portion 47*a* of the cover 47, the side member 46, the partition plate 48*a*, the shaft opening portion 48*b*, the partition plate 48*c* on the cover side and the piston 14. Because the pressure of this plenum 53 is reduced by the operation of the pump chamber 22 of the piston pump 10', air is sucked through the shaft opening portion 48*b*. The noise generated at the sliding portions can be prevented from going out when the components having a large number of sliding portions are encompassed in this way by the enclosure.

Figure 21:
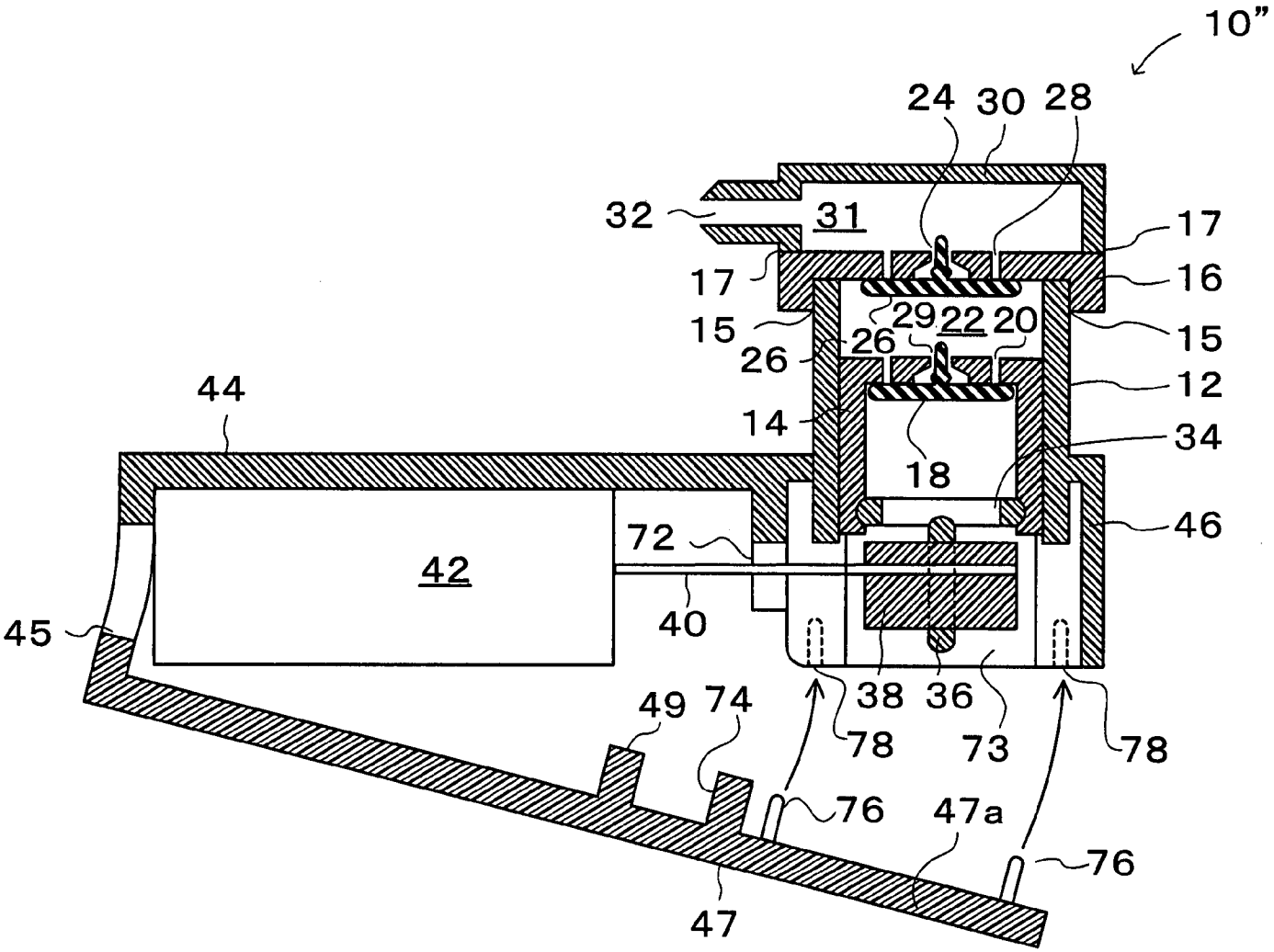
FIG. 21 shows a section of the piston pump according to the embodiment of the present invention under the state where suction/exhaust is reversed and a cover with pin of the motor housing is opened.

FIG. 21 is a sectional view showing a piston pump 10" according to still another embodiment. Because the basic construction is the same as the one shown in FIG. 1, the common portions are omitted. This piston pump 10" is directed to suction or pressure reduction but not to exhaust. Therefore, handle portions of the valves 18 and 26 are inserted and fixed from the lower side in the drawing into the insertion holes 24 and 29 in the valve plate 16 and the piston 14. In this construction, air moves in the reverse direction to the explanation of FIG. 1, the pressure of the space 31 is reduced and air is sucked from outside through the discharge port 32. A wall 73 at the depth that is omitted from FIG. 1 for simplification is expressed beyond the crank shaft 38. Holes 78 and 78 for accommodating projections 76 and 76 disposed on the cover 47 are disposed at both ends of the wall 73 at the depth. The cover 47 can be kept under the closed state when these projections 76 and 76 are fitted (inserted) into the holes 78 and 78, respectively. Fitting between the projection 76, 76 and the holes 78, 78 may be loose fit but is preferably close fit to a certain extent. Fitting may also be sliding fit. This is to obtain desired pull-out resistance. The shape may be a simple rod shape or a rod shape having a projection at an intermediate part. When a polymer material such as a plastic material is used, the shape is more preferably the simple rod shape. At this time, the partition plate 72 having the opening on the side of the housing substrate material 44 and the partition plate 74 on the side of the cover 47 butt against each other and form the plenum 53 shown in FIG. 20.

Figure 22:
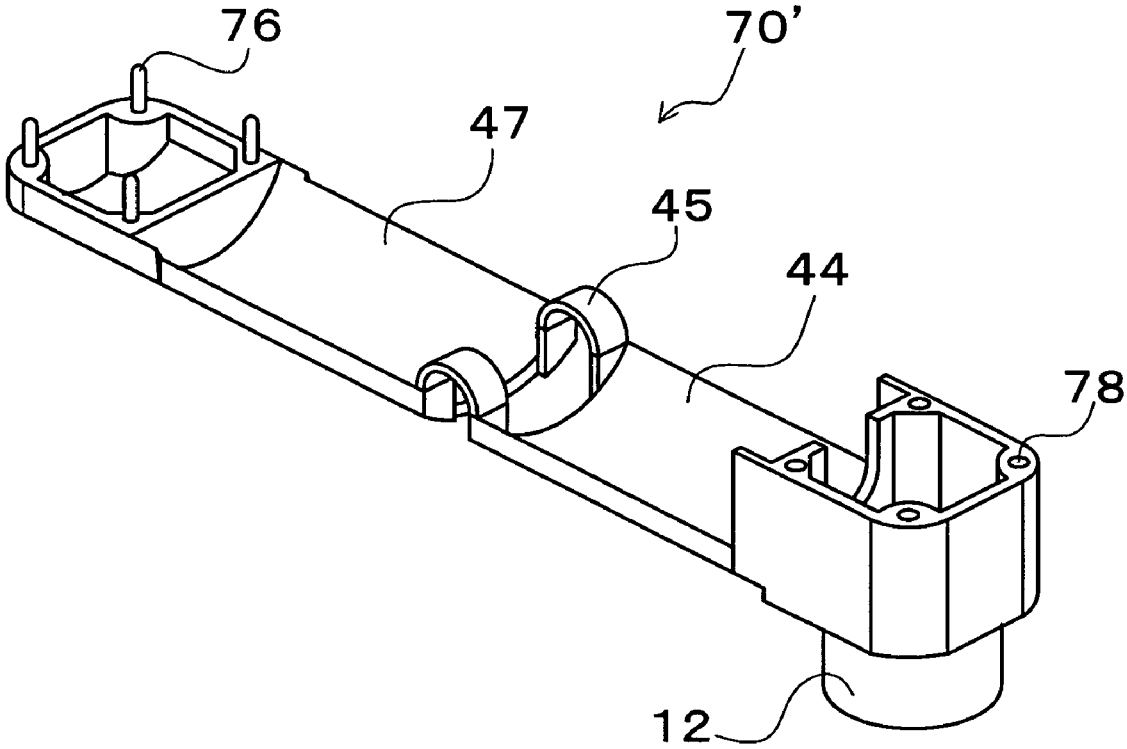
FIG. 22 is a perspective view showing a production form of a motor housing having a cover with pin and used for the piston pump according to the embodiment of the present invention.
Figure 23:
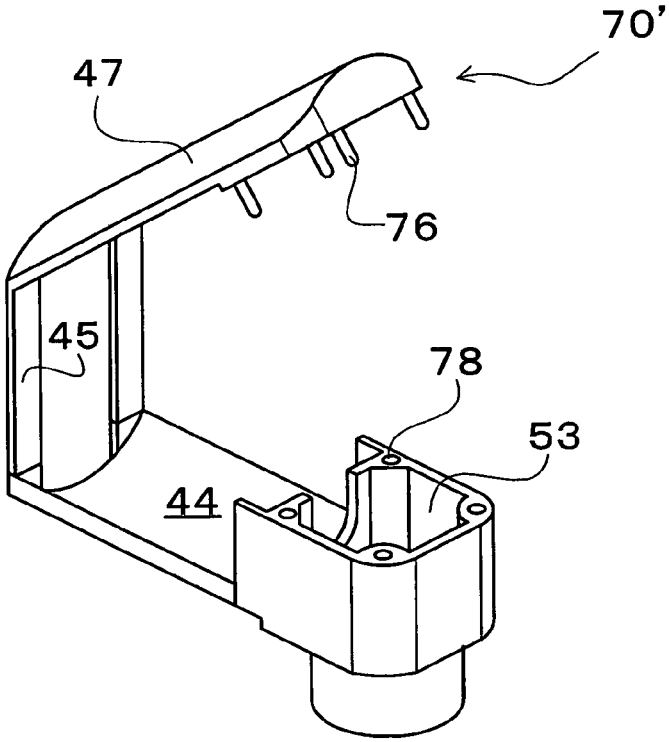
FIG. 23 is a perspective view showing an assembly form of the motor housing having a cover with pin and used for the piston pump according to the embodiment of the present invention.

FIGS. 22 and 23 illustrate a housing 70' equipped with a cylinder that is produced by providing a closing mechanism of the cover 47 shown in FIG. 21 to the housing 70 with the cylinder shown in FIG. 3. When the shape is such a planar shape, molding by injection molding, etc, becomes easier and more preferable. Four projections 76 constituting the closing mechanism of the cover 47 protrude upward. Each side member 45 operating as the hinge is under the return state (FIG. 23) from the state where it is largely bent (FIG. 22) and its form is shaped so that the closing mechanism can operate. It can be seen that the wall covering the side surface of the plenum 53 is molded integrally with the cylinder 12. Holes 78 are bored at four corners of this rectangular wall and can fit to the projections 76.

Figure 24:
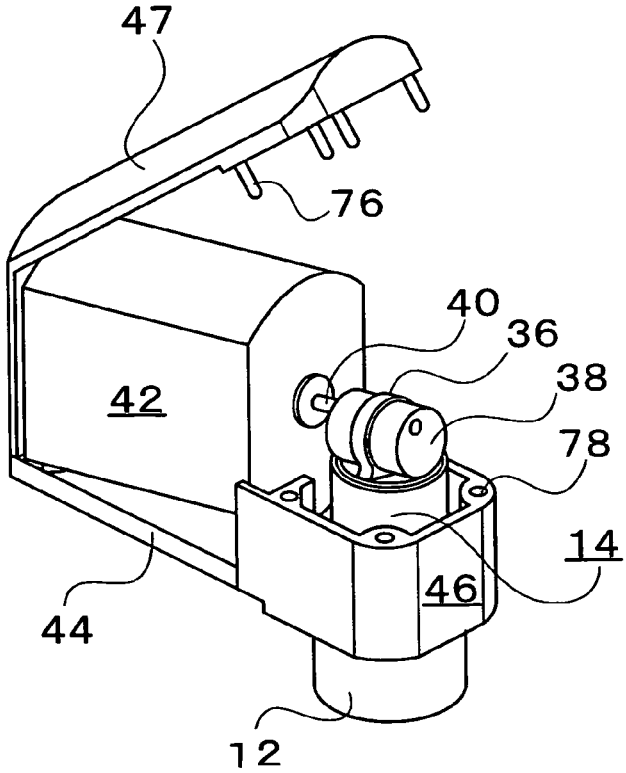
FIG. 24 is a perspective view showing the assembly form when a motor engaging with a piston is inserted into a motor housing having a cover with pin and used for the piston pump according to the embodiment of the present invention.

FIG. 24 illustrates the state where the motor 42 is accommodated half inside the motor housing. The driving shaft 40 of the motor 42 is pressed into the crank shaft 38 and the crank shaft 38 is inserted into the ring opening portion 36*c* as the inside space of the connecting ring 36. The coupling ring 34 coupling with the connecting ring 36 engages with the spherical seat 37 of the piston 14 (see FIG. 2). When the cover 47 is pushed in from this state, the pump assembly can be easily fabricated. The valve plate is hereby omitted for simplification but such an assembly can be assembled after the valve plate is bonded by ultrasonic welded in practice.

Figure 25:
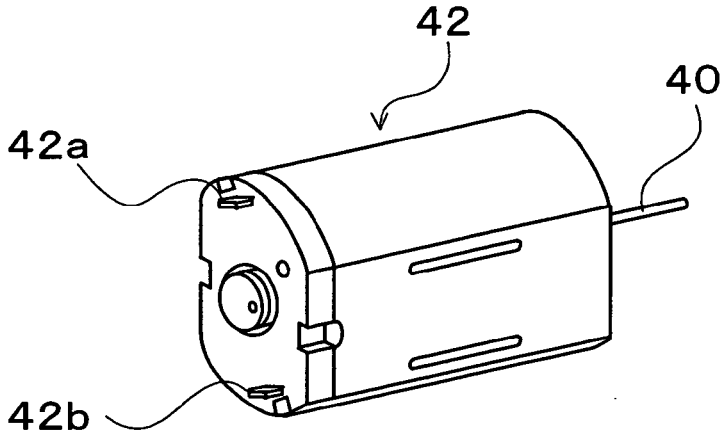
FIG. 25 is a perspective view showing an overall form of the motor shown in FIG. 24.

FIG. 25 illustrates the motor 42 used in this embodiment. Terminals 42*a* and 42*b* protruding up and down from an insulating end face are provided on the opposite side of the driving shaft 40 of the motor 42 and supply necessary power to the motor 42. Connection is easy because these terminals 42*a* and 42*b* are exposed from the opening portion of the side member 45.

Figure 26:
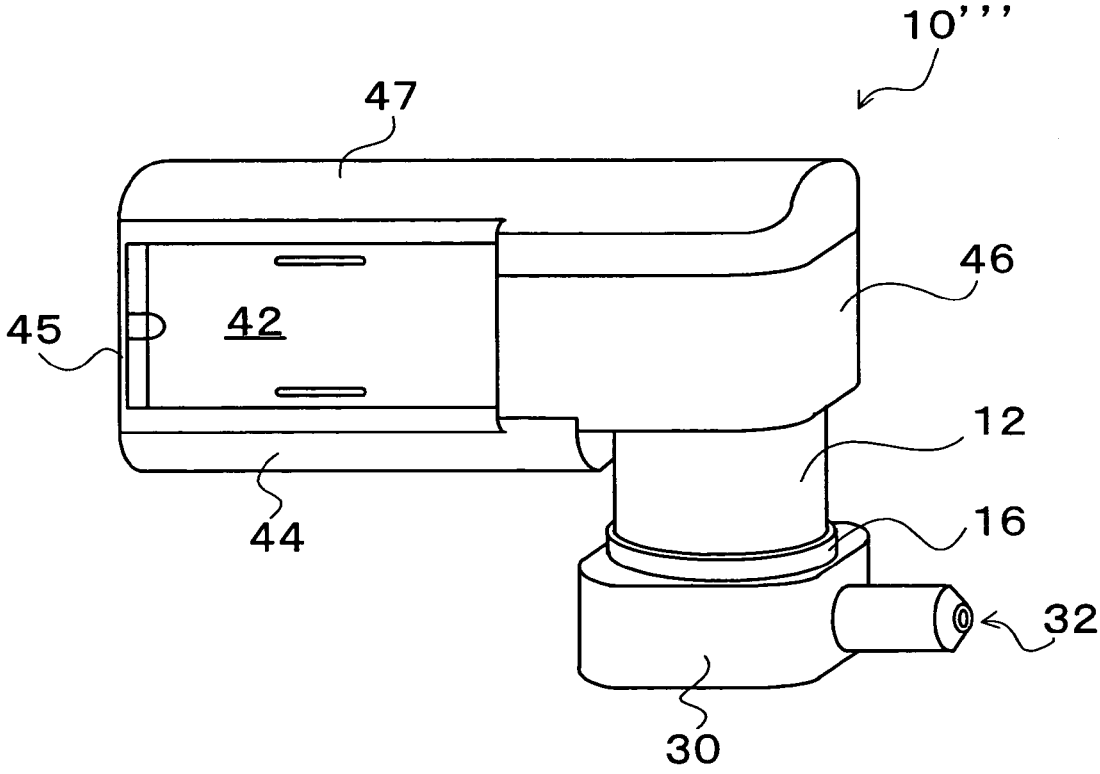
FIG. 26 is a perspective view under the state where the piston pump according to the embodiment of the present invention has been assembled.

FIG. 26 is a sketch showing the piston pump 10''' under the state in which the cover 47 shown in FIG. 24 is fitted. The valve plate 16 is welded to the top of the cylinder 12 and the manifold 30 having the discharge port 32 is further welded. The direction of the discharge port 32 faces right in the drawing like a beak of a duck moving forth on a water surface contrary to the case of FIG. 1.

Figure 27:
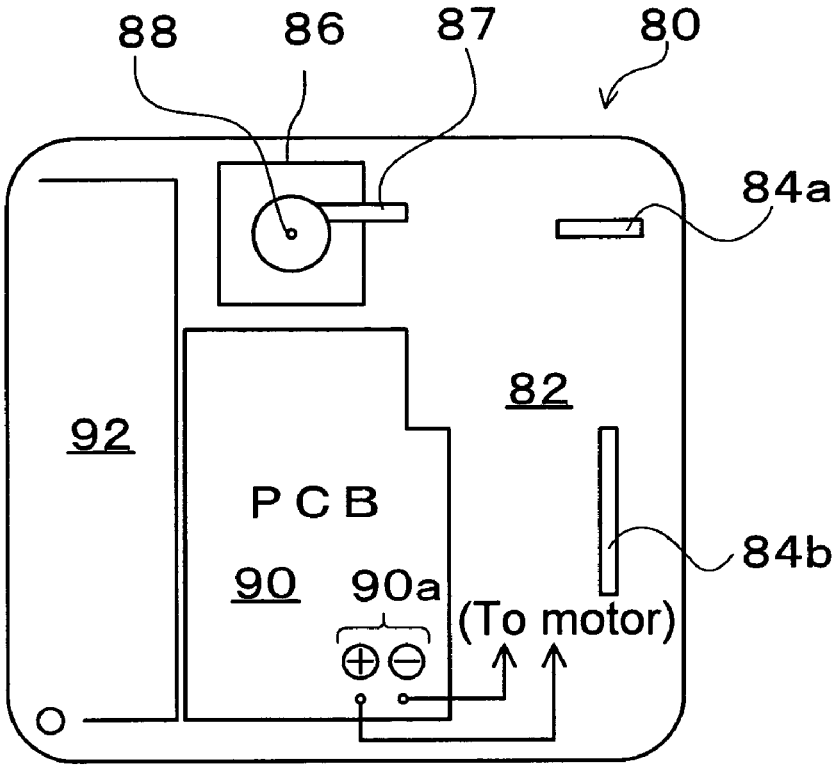
FIG. 27 is an upper surface view showing a control principal portion of a blood pressure monitor to which the piston pump according to the embodiment of the present invention can be fitted.
Figure 28:
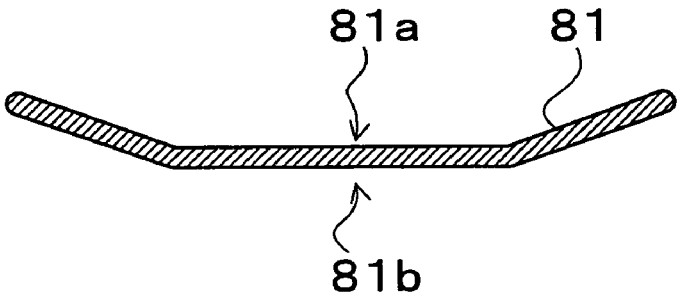
FIG. 28 is a sectional view of a substrate of the control principal portion shown in FIG. 27.

Referring to FIGS. 27 to 30, a control main portion 80 of the blood pressure monitor having the pump assembled therein will be explained. A battery accommodation portion 92 is arranged to the left in an elongated form inside the rectangular control main portion 80. A control portion 90 of a printed wiring board (PCB) is arranged on the right side of this battery accommodation portion 92. A power source portion 90*a* is arranged in this control portion and supplies power to the pump. A pump accommodation portion 82 is defined by a transverse pump support rib 84*a* and a longitudinal pump support rib 84*b* on the further right of the control portion 90. A solenoid valve 86 is arranged above the control portion 90 and is opened and closed in accordance with the control of the control portion 90. An opening portion 88 at the center of the solenoid valve 86 is an air discharge port and air is sent from thence to a cuff pressing an arm or a wrist. FIG. 28 illustrates the section of a substrate 81 for putting the components described above on a substrate surface 81*a*. Both ends are obliquely lifted up to a certain extent so that a display surface 81*b* of the blood pressure monitor at the lower part in the drawing can be neatly designed.

Figure 29:
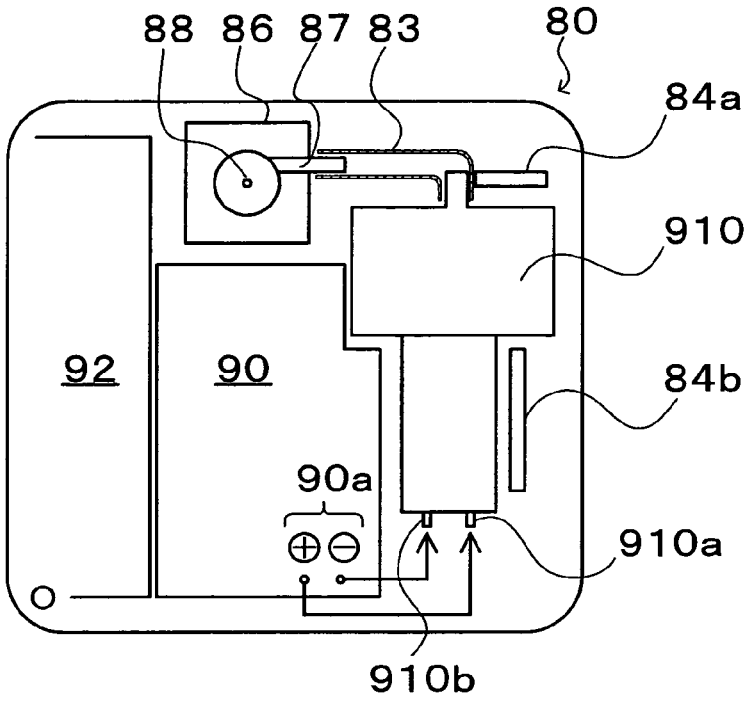
FIG. 29 is an upper surface view of a pressurization portion when a diaphragm pump according to the prior art is fitted to the control principal portion shown in FIG. 27.
Figure 30:
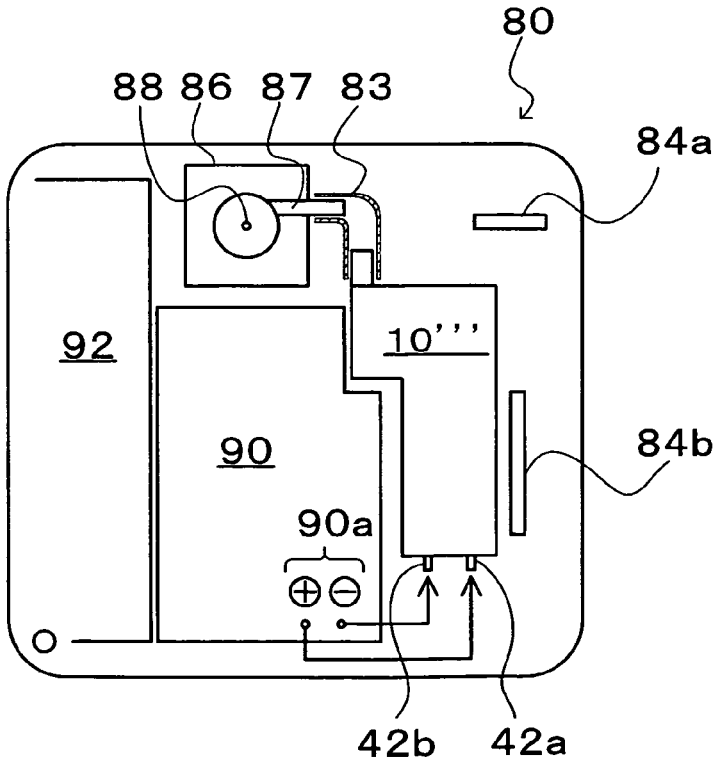
FIG. 30 is an upper surface view of the control principal portion when the piston pump according to the present invention is fitted to the control principal portion shown in FIG. 27.

FIG. 29 illustrates the state in which a diaphragm pump 910 is stored in the pump accommodation portion 82 shown in FIG. 27. The pump support ribs 84*a* and 84*b* effectively support the diaphragm pump 910 and power is supplied from the power source portion 90*a* to the electrode terminals 910*a* and 910*b* through lead wires. A discharge port of the diaphragm pump 910 is connected by a flexible tube 83 in such a manner as to send discharge air to a suction port 87 of the solenoid valve 86 connected to the other end of the flexible tube 83. FIG. 30 illustrates the case where the diaphragm pump 910 is replaced by the piston pump 10''' of the embodiment shown in FIG. 26. Air is sent from the discharge port 32 of the piston pump 10''' to the suction port 87 of the solenoid valve 86 through the tube 83 connected in the same way as in FIG. 29. The rest of the constructions and operations are the same and are therefore omitted. It can be understood from these drawings that the pump has high versatility because the piston pump 10''' of FIG. 26 can be easily fitted to the control main portion 80 of the blood pressure monitor using the diaphragm pump.

Figure 31:
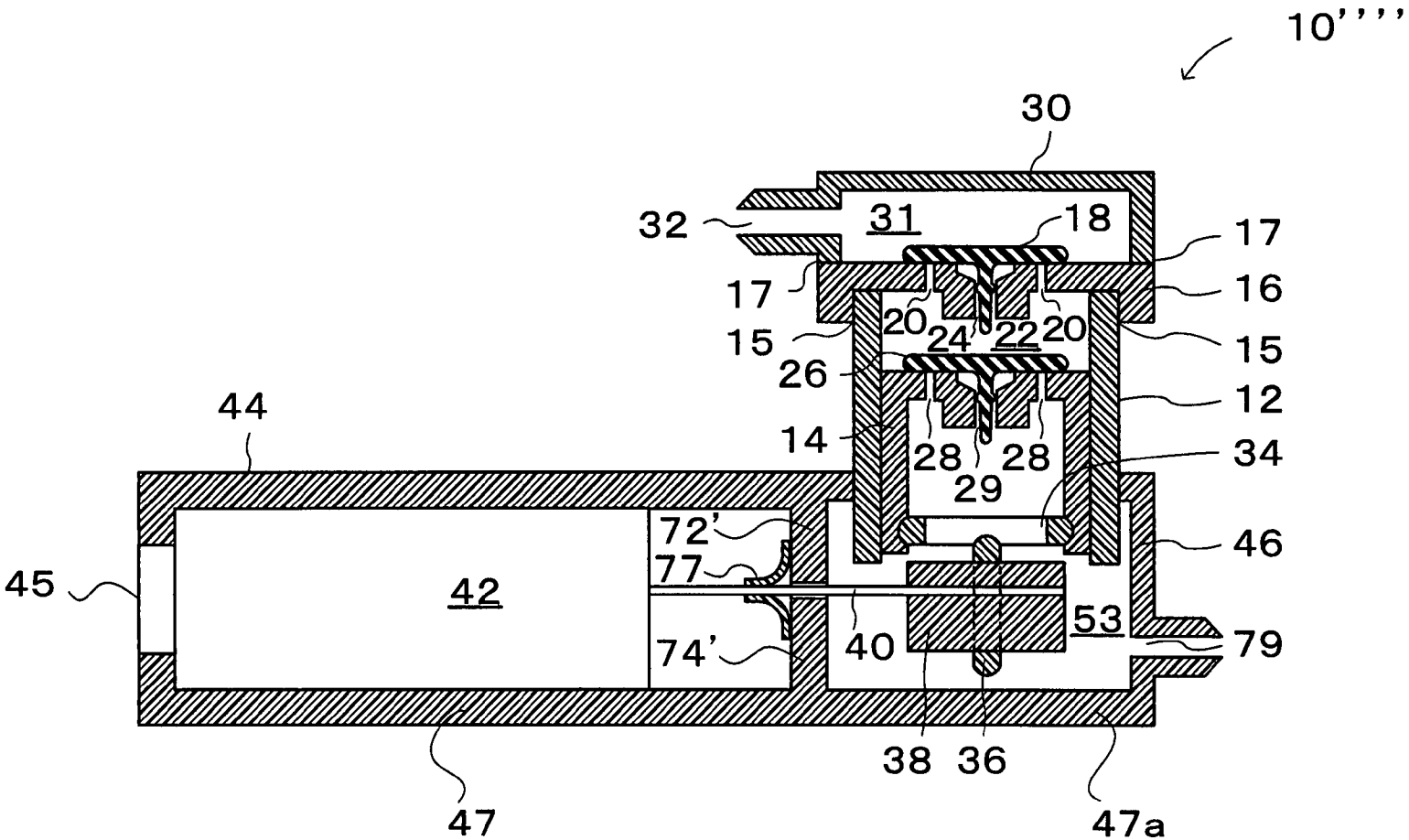
FIG. 31 shows a section of the piston pump according to the embodiment of the present invention under the state where a crank chamber at a cylinder lower part is sealed and a motor housing equipped with a crank chamber suction port is closed.
Figure 32:
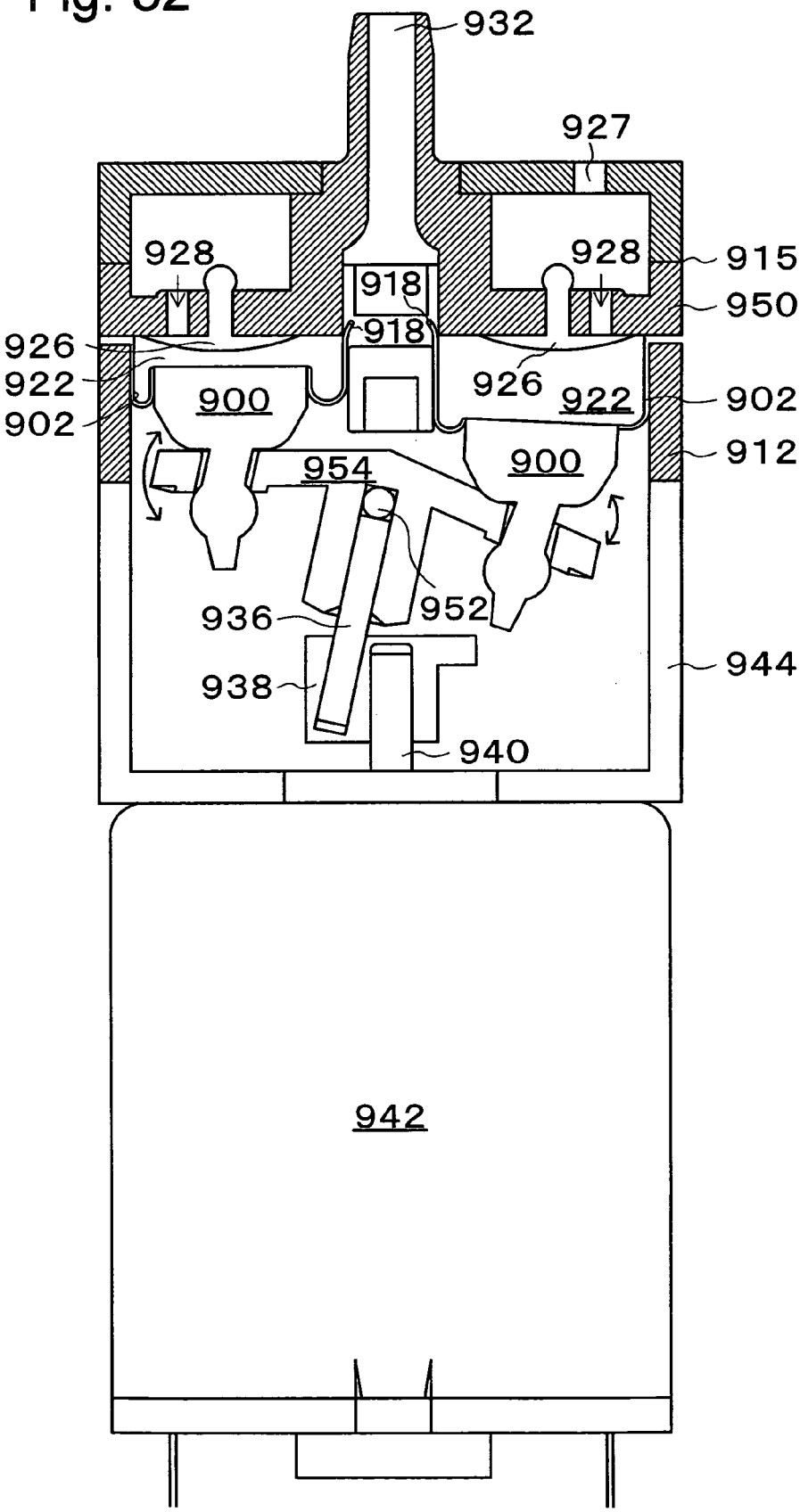
FIG. 32 is a view showing, partly in section, a diaphragm pump of a Comparative Example.

FIG. 31 shows in section a piston pump 10'''' according to still another embodiment. The explanation of overlapping portions will be omitted because the construction is basically the same as the constructions shown in FIGS. 1, 20 and 21. Each wall as the enclosure encompassing the plenum 53 is constituted by a partition plate 72' having a smaller shaft opening portion, a partition plate 74' of the cover 47, the side member 46 and a right side portion 47*a* of the cover 47. A rip-seal type rubber seal 77 is fitted to the partition plates 72' and 74' to increase air-tightness. The rubber seal 77 need not be disposed when air-tightness is not much required. The side member 46 has a suction port 79 facing right. According to this construction, a pump capable of sucking and exhausting (from the discharge port 32), though small in size, can be provided. Incidentally, the discharge port 32 can be directed in all directions as described so far and this can be accomplished by an extremely convenient method of changing the direction at the time of deposition of the manifold 30.

The piston pump of the present invention described above includes the suction port through which the gas sucked in accordance with the change of the volume of the pump chamber defined by the cylinder and the piston due to the reciprocating motion of the piston inserted into the cylinder passes, the exhaust port through which the gas exhausted in accordance with the change of the volume of the pump chamber passes, the suction valve disposed at the suction port arranged at the top of the piston, and the exhaust valve disposed at the exhaust port arranged at the top of the cylinder. Therefore, the piston pump has the advantages that the construction is simple, the number of components is small and the scale can be rendered compact. Consumed current is small and pump efficiency is high.

What is claimed is:

1. A piston pump including:

a cylindrical cylinder having a top portion;

a piston being formed in a cup shape with an outer peripheral surface and a cylindrical hollow portion inside, the piston reciprocating inside the cylinder as the outer peripheral surface slides directly on an inner wall of the cylinder;

a suction port through which gas is sucked into a pump chamber defined by a side of wall of the top portion of the cylinder, a side wall of the cylinder and a top face of the piston;

an exhaust port through which the gas is discharged from the pump chamber;

a recess portion disposed continuously around an inner wall of the cylindrical hollow portion of the piston in a circumferential direction of the piston;

a coupling ring having a projecting portion that fits on the recess portion such that the coupling ring engages with the piston wherein the cylindrical hollow portion communicates with a center portion of the coupling ring; and a connecting ring connected to the coupling ring that transmits mechanical force from the connecting ring to the piston;

wherein the piston pump sucks the gas from the suction port and discharges the gas through the exhaust port as a volume of the pump chamber is changed by reciprocating motion of the piston;

wherein the suction port is arranged at the top portion of the cylinder with a suction valve, which opens when the volume of the pump chamber is increased; and the exhaust port is arranged at the piston with an exhaust valve, which is umbrella-shaped and is arranged outside the pump chamber and opens when the volume of the pump chamber is decreased, the piston having a hole at a center thereof in order to fix the exhaust valve; and wherein an inner diameter of the cylinder is adaptedly formed not exceeding 20 mm.

2. A method of producing a piston pump including a cylindrical cylinder, a piston reciprocating inside the cylinder; a suction port through which gas is sucked into a pump chamber defined by the cylinder and the piston and an exhaust port through which the gas is discharged from the pump chamber; the method comprising the steps of:

producing a piston pump pre-assembly comprising the cylinder a cylinder top portion in which the exhaust port is formed, an exhaust valve fitted into a hole in the cylinder top portion so as to cover the exhaust port, and a manifold so that an air chamber is defined wherein the cylinder and the cylinder top are welded by ultrasonic welding and the cylinder top and the manifold are welded by ultrasonic welding so as to be air-tight;

conducting a leakage inspection of the air chamber of the piston pump pre-assembly by measuring a change of a pressure applied to the air chamber;

repairing or discarding the piston pump pre-assembly if it fails to pass the leakage inspection and proceeding with manufacturing the piston pump if the piston pump pre-assembly passes the leakage inspection;

fitting a valve into a hole on the top of the piston so as to cover the suction port thereon wherein the piston is formed in a cup shape with an outer peripheral surface and a cylindrical hollow portion inside which piston reciprocates inside the cylinder as the outer peripheral surface slides directly on an inner wall of the cylinder;

press-fitting a coupling ring into a recess disposed continuously around an inner wall of the cylindrical hollow portion in a circumferential direction of the piston such that a projection portion of the coupling ring fits on the recess portion such that the coupling ring engages with the piston wherein the cylindrical hollow portion communicates with a center portion of the coupling ring wherein a connecting ring is integrally formed with the coupling ring;

press-fitting a crank shaft so a driving shaft of a motor;

inserting the crank shaft into the connecting ring so that a piston-cam-motor sub-assembly is assembled; and inserting the piston of the piston-cam-motor sub-assembly into the cylinder of the piston pump pre-assembly so as to produce a piston pump.

3. The piston pump according to claim 1, wherein the suction valve is umbrella-shaped and arranged inside the pump chamber.

* * * * *